US010557240B2

(12) United States Patent
Krekel et al.

(10) Patent No.: US 10,557,240 B2
(45) Date of Patent: Feb. 11, 2020

(54) OFFSHORE STRUCTURE, SUPPORTING MEMBER, SKID SHOE, METHOD FOR MOVING A CANTILEVER

(71) Applicant: GustoMSC Resources B.V., Schiedam (NL)

(72) Inventors: Michiel Krekel, Schiedam (NL); Wilhelmus Coenradus Johannes Jozephus Woldring, Schiedam (NL); Mark Cornelius Marinus Franciscus Rommens, Schiedam (NL)

(73) Assignee: GustoMSC Resources B.V., Schiedam (NL)

( * ) Notice: Subject to any disclaimer, the term of this patent is extended or adjusted under 35 U.S.C. 154(b) by 0 days.

(21) Appl. No.: 15/735,444

(22) PCT Filed: Jun. 13, 2016

(86) PCT No.: PCT/NL2016/050425

§ 371 (c)(1),
(2) Date: Dec. 11, 2017

(87) PCT Pub. No.: WO2016/200265

PCT Pub. Date: Dec. 15, 2016

(65) Prior Publication Data

US 2018/0282965 A1 Oct. 4, 2018

(30) Foreign Application Priority Data

Jun. 12, 2015 (NL) ..... 2014966
Jun. 19, 2015 (NL) ..... 2015005
Jul. 10, 2015 (NL) ..... 2015157

(51) Int. Cl.
*E02B 17/02* (2006.01)
*E21B 15/00* (2006.01)
(Continued)

(52) U.S. Cl.
CPC ..... *E02B 17/021* (2013.01); *E21B 15/003* (2013.01); *E02B 2017/0056* (2013.01); *E21B 15/02* (2013.01)

(58) Field of Classification Search
CPC ..... E02B 17/021; E02B 2017/0056; E21B 15/003; E21B 15/02
See application file for complete search history.

(56) References Cited

U.S. PATENT DOCUMENTS 3,477,235 A * 11/1969 Hester, Jr. ..... E02B 17/00 175/5
4,065,934 A * 1/1978 Dysarz ..... E02B 17/021 114/258

(Continued)

FOREIGN PATENT DOCUMENTS

EP 2201179 A1 6/2010
GB 2139267 A 11/1984

(Continued)

OTHER PUBLICATIONS

International Search Report PCT/NL2016/050425 dated Oct. 11, 2016.

(Continued)

*Primary Examiner* — Benjamin F Fiorello
(74) *Attorney, Agent, or Firm* — Pillsbury Winthrop Shaw Pittman, LLP

(57) ABSTRACT

Method for moving a cantilever with respect to a deck of an offshore structure in longitudinal and rotational direction, around a predetermined virtual vertical axis, without providing a fixed vertical rotation shaft, comprising providing an offshore structure with a cantilever movable with respect to a deck of the offshore structure, providing cantilever rails on the bottom side of the cantilever and providing a supporting member or a skid shoe to support the cantilever on the deck, wherein the supporting member or the skid shoe (Continued)

has a top part configured for allowing the cantilever rail to have an angle deviating from the centerline of the skid shoe during rotation of the cantilever.

17 Claims, 20 Drawing Sheets

(51) Int. Cl.
*E02B 17/00* (2006.01)
*E21B 15/02* (2006.01)

(56) References Cited

U.S. PATENT DOCUMENTS 4,224,005 A 9/1980 Dysarz
4,269,542 A * 5/1981 Mueller ..... E02B 17/021 405/196
6,171,027 B1 1/2001 Blankestijin
6,729,804 B1 5/2004 Roodenburg et al.
6,901,998 B1 6/2005 Roodenburg et al.
6,932,553 B1 8/2005 Roodenburg et al.
8,287,212 B2 * 10/2012 Roper ..... E02B 17/00 405/196
8,439,606 B2 * 5/2013 Foo ..... E21B 15/003 405/201
8,926,224 B2 * 1/2015 Seng ..... E21B 15/003 405/201
9,879,395 B2 * 1/2018 Foo ..... E02B 17/021
2004/0151549 A1 * 8/2004 Roodenburg ..... E02B 17/021 405/201
2012/0224925 A1 9/2012 Roper
2015/0034383 A1 * 2/2015 Roodenburg ..... B66C 5/10 175/5

FOREIGN PATENT DOCUMENTS

GB 2166176 A 4/1986
WO 98/31585 A1 7/1998
WO 2004/035985 A1 4/2004
WO 2007/043856 A1 4/2007
WO 2009/035448 A1 3/2009
WO 2013/133694 A1 9/2013

OTHER PUBLICATIONS

Written Opinion dated Feb. 15, 2019 issued in corresponding Singapore Patent Application No. 11201710274W.
Third Party Observation dated Feb. 14, 2019 submitted in corresponding European Patent Application No. 16745518.7.
Notification of the First Office Action dated Mar. 20, 2019 issued in corresponding Chinese Patent Application No. 201680042484.3 with English translation.

* cited by examiner

OFFSHORE STRUCTURE, SUPPORTING MEMBER, SKID SHOE, METHOD FOR MOVING A CANTILEVER

CROSS-REFERENCE TO RELATED APPLICATIONS

This is the U.S. National Stage of PCT/NL2016/050425, filed Jun. 13, 2016, which in turn claims priority to: Netherlands Application No. 2014966, filed Jun. 12, 2015, Netherlands Application No. 2015005 filed Jun. 19, 2015, and Netherlands Application No. 2015157 filed Jul. 10, 2015, the contents of all applications being incorporated herein by reference in their entireties.

FIELD OF THE INVENTION

The invention relates to a drilling jack-up with a cantilever.

BACKGROUND

Drilling jack-ups are in many cases fitted with a drilling derrick mounted on the aft end of a cantilever, which can be moved over the stern (or side) of the jack-up. In order to drill multiple wells or reach over an array of existing wells, the drilling tower derrick needs to cover a drilling envelope that is defined by a certain length and width.

The longitudinal movement of the drilling derrick is effectuated by moving the cantilever in the longitudinal direction. This is done by a skidding system, performing the so-called X-movement of the cantilever. In the floating condition of the jack-up, the cantilever is fully retracted. After elevation of the jack-up at the site, the cantilever can be moved in X-direction to the required longitudinal position.

The transverse movement (or Y-movement) of the drilling tower derrick can be created by shifting the drilling tower derrick in transverse direction over the cantilever, or by transverse shifting of the cantilever in which case the drilling derrick remains at its fixed position on the cantilever. The first method of transversely shifting the drilling derrick has severe drawbacks, especially the load reduction that is caused when the drilling derrick is shifted at a significant offset from its central position on the cantilever. Therefore the modern state-of-the-art cantilevers apply the transverse shifting of the whole cantilever.

The combined longitudinal and transverse cantilever movement can be effectuated as described in U.S. Pat. No. 6,171,027.

The transverse movement of the cantilever is limited by fixed structures on the maindeck, such as the jackhouses with the legs. This limit will be more restrictive in jack-ups which do not have a wide stern and consequently do not have a large spacing between the aft legs, such as is the case in ship shaped self-propelled jack-ups. As a consequence, the transverse movement of the drill tower will be limited in such jack-ups, and it may not be possible to reach the required width of the drilling envelope.

WO2004035985 describes a drilling rig comprising a cantilever which is movable in a first direction and a second direction, a supporting cart disposed between the cantilever and the drilling rig, wherein the first movement is a translational movement and the second movement is a rotational movement. Since the supporting cart is an additional structure that is connected to the drilling rig having a fixed point of rotation, it is a heavy structure reducing the load bearing capacity of the jack-up and/or the cantilever.

The present invention is intended to resolve at least one of the abovementioned drawbacks.

DESCRIPTION OF THE INVENTION

Thereto, the invention comprises a method for moving a cantilever with respect to a deck of an offshore structure in longitudinal and rotational direction, around a predetermined virtual vertical axis, without providing a fixed vertical rotation shaft, comprising providing an offshore structure with a cantilever movable with respect to a deck of the offshore structure, providing cantilever rails on the bottom side of the cantilever and providing a supporting member or a skid shoe to support the cantilever on the deck, wherein the supporting member or the skid shoe have a bottom part and/or a top part respectively, of which the bottom part and/or the top part of the supporting member or the top part of the skid shoe is configured to allow the cantilever rail or the deck rail to have an angle deviating from the centerline of bottom part and/or top part during rotation of the cantilever.

By providing such a supporting member or a skid shoe that accommodates the rotational movement of the cantilever, and thus the off-centerline movement of the cantilever rails, a relatively reliable and less complex structure can be obtained. By configuring the bottom part and/or the top part of the supporting member or the top part of the skid shoe to allow movement of the deck rail and/or of the cantilever rail to deviate from the centerline of the respective part, rotational movement of the cantilever with respect to the deck is accommodated.

A supporting member can be made from a solid piece of steel. The supporting member can e.g. be executed as a forging/casting, optionally further machined. The supporting member can also be a welded structure. In case of greater building height, a welded structure might have the preference.

The two skid shoes can be placed apart and fixed to the deck at a distance corresponding with the distance between the cantilever rails. The skid shoes can be at an equal distance from the longitudinal centerline of the vessel or jackup. The centerline of the skid shoe can be parallel to the centerline of the vessel or jack-up. Each skid shoe is arranged to support a cantilever rail and allow it to move through in a longitudinal direction.

The skid shoe may form an upside down T-shaped track, with side walls fixed to a bottom plate or directly to the deck and top plates forming a slot along the centerline of the shoe. The shoe can be provided with guiding elements, preferably sliding bearings, preferably at least at one side wall and/or on the bottom surface.

Optionally, the cantilever rail interacts directly with the skid shoe, meaning there is no support member between the cantilever rail and the shoe. The top plates of the shoe hold the cantilever rail in place in case when upward pulling loads occur.

The skid shoe or supporting member can be equipped with a skid unit for actuating longitudinal movement, for example a rack and pinion type skid unit. When the forward skid shoe has no skid unit, longitudinal movement of the cantilever can be induced by other actuating means, for example by the skid units on the aft supporting members.

This rotation around the vertical axis is sometimes referred to as yaw and is sometimes indicated with an angle $\Psi$. The centerline of the platform such as a vessel or a jack-up is the X-direction. The Y-direction is perpendicular to the X-direction in the horizontal plane, i.e. in the plane of the deck. The vertical axis is perpendicular with respect to the plane of the deck, i.e. with respect to the XY-plane.

Advantageously, the supporting member comprises a bottom part for engagement with the deck rail and a top part for engagement with the cantilever rail, wherein the top part and the bottom part have an oblique angle with respect to each other. By providing such an oblique angle between the orientation of the top and bottom part, the rotational movement of the cantilever can be accommodated, as well as the longitudinal movement. The deck rails can be curved or straight and the bottom part can be arranged correspondingly to engage with the curved or straight deck rail respectively. Preferably, the bottom part has a curvature corresponding to a curvature of a deck rail on which it is engaged.

The, for example, aft supporting members can be placed on and arranged to move on a straight or curved deck rail that may extend in transverse direction, as described later. The bottom part of an aft supporting member may interact with the aft deck rail and can be provided with a skid unit to effectuate rotational movement of the cantilever (psi-direction). The top part may interact with a cantilever rail and can be provided with a skid unit to effectuate the longitudinal movement of the cantilever. The skid units of the aft support member can be of the rack and pinion type, or any other type. By providing a skid unit, the skid unit can actively move the cantilever with respect to the supporting member. By omitting a skid unit, the supporting member is then arranged to follow the movement induced by other actuating means, such as the opposite located skidboxes. For example, the aft skidboxes can be provided with a skid unit and the forward skidboxes not, the latter thus following the movement induced by the aft skidboxes, thus moving the cantilever. Preferably, there is one supporting member provided per deck rail, however more supporting members per deck rail or on each side are possible, also one or more deck rails per side of the cantilever. Preferably, the top part of the supporting member can be equipped with a skid unit and the bottom part is not equipped with a skid unit.

Positioning the, forward, curved deck rails at a non-zero angle $\alpha$ has several advantages. In this position a deck rail can counteract reaction forces (longitudinal to the cantilever) without the specific need of a rotation axis fixed to the deck or even an additional reaction arm. Further, the non-zero angled position of the deck rail may improve guidance and alignment of the corresponding supporting member, may improve transfer of forces driving the supporting member to move along the guide, and may reduce the risk of skewing of the supporting member on or in the curved deck rail.

In addition to the improved guidance as a result of the non-zero angled position of the deck rail, the forward supporting members can be connected with a connecting beam to further ensure alignment of the supporting members with respect to each other and to keep them at a fixed distance to the point of rotation.

Preferably, the top part of the supporting member or skid shoe is configured to allow rotational movement of the cantilever rail to which it is engaged, during rotation of the cantilever with respect to the deck. By providing such a top part, separate rotating means can be obviated. Rotation of the cantilever is then facilitated by the top part of the supporting member or skid shoe, e.g. a separate fixed rotation shaft can be obviated.

Advantageously, the top part and/or the bottom part of the supporting member is configured to allow off-centerline movement of the rail that is engaged thereto with respect to the centerline of the respective engaged top or bottom part. By allowing such off-centerline movement, i.e. allowing some play in a guide element of the top and/or bottom part for cooperating with the respective rail, rotational movement of the cantilever with respect to the deck can be accommodated. For example, the supporting member may thereto be provided with curved or V-shaped guide walls to guide the respective rail. The centerline of the top part or the bottom part can be considered as the direction coinciding with the centerline of the rail when the rail is in neutral, non-deviated position.

More advantageously, the top part of the supporting member or skid shoe comprises a guide element for receiving the cantilever rail, wherein the guide element has a width larger than the width of the cantilever rail, to allow for rotational movement of the cantilever rail. By providing such a larger width, the rotational movement of the cantilever rail, during rotation of the cantilever, can be accommodated within the width of the guide element. Movement of the cantilever rail off-centerline with respect to the centerline of the guide element is thus possible.

Alternatively and/or additionally, the top part of the supporting member or skid shoe comprises a guide element for receiving the cantilever rail, the guide element has V-shaped guide walls to allow for rotational movement of the cantilever rail. Such V-shaped guide walls can be embodied as concave shaped guide walls wherein the guide walls are flaring outwardly towards outer sides of the skid shoe or supporting member. The V-shaped guide walls or concave shaped guide walls also allow for off-centerline movement, with respect to the centerline of the guide element, of the cantilever rail during rotation of the cantilever.

In an embodiment, the supporting member is actuated by a skid unit, such as a rack and pinion system.

The supporting members need actuators to actively move them, or move a rail through. The actuating system of a supporting member is called a skid unit and a supporting member can be configured with a skid unit for the top part, the bottom part, skid unit for both the upper and bottom part or without any skid unit. When the top part of a supporting member is passive (without skid unit), the cantilever rail can be locked (with clamp, pin, skid unit) to the top part of the supporting members to prevent slip of the cantilever rail through the upper guide and/or skewing of the rail in the upper guide while rotating the cantilever.

Optionally, skid units can be fitted to the bottom part as well as the to part of each of these supporting members, which effectuate the following movements of the cantilever. The skid units at the top part of the supporting member effectuate the longitudinal movement of the cantilever. In general all the supporting members can have skid units or driving mechanisms for both directions (longitudinal- and/or psi-direction). Optionally, the aft supporting members are equipped with skid units.

In a preferred alternative embodiment, the skid shoe is fixedly mounted onto the deck of the platform. Preferably, two skid shoes are provided each mounted in a symmetrical fashion with respect to the X-direction of the deck. By providing skid shoes as alternative to the supporting members, the free height between the deck and the cantilever may become smaller, which may be, in some circumstances and/or depending on client requirements, advantageous.

In an embodiment of the skid shoes, the top part of the skid shoe comprises adjustable guide walls to receive the cantilever rail therebetween and to allow rotational movement of the cantilever rail. By providing adjustable guide walls, the off-centerline movement of the cantilever rail can be facilitated. In an embodiment, the guide walls can be actuated and may thus drive the movement of the cantilever rails additionally or alternatively to other actuation means for driving the cantilever.

Further, the invention relates to an offshore structure comprising a platform, such as a vessel or a jack-up, having a deck with an X-direction corresponding to the centerline of the platform, a cantilever mountable on the deck and movable with respect to the deck of the platform, a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis; such that the cantilever is movable between a retracted position in which it substantially is above the deck, and an extended position in which it is substantially extended outside of the deck; wherein the skidding system comprises a pair of longitudinal cantilever rails mounted to a bottom side of the cantilever, and a rotating system arranged to support and allow rotation of the cantilever with respect to the deck around the vertical axis; a supporting system arranged to support the cantilever on the deck mounted at a distance from the rotating system along the X-direction; supporting members arranged to engage the longitudinal cantilever rails with the rotating system or the supporting system; wherein the supporting system comprises at least one deck rail arranged in a Y-direction substantially transverse to the X-direction; and wherein the rotating system comprises at least two deck rails mounted in symmetrical fashion with respect to the X-direction and having an |[DJv1]angle ($\alpha$) with respect to the Y-direction.

By providing such an offshore structure wherein the rotating system comprises two deck rails having such an angle, the rotation movement of the cantilever can be allowed, while no physical vertical rotation shaft needs to be provided. The rotation is allowed around a virtual vertical rotation axis. This may provide for a lighter and/or less complex structure. The angle can be an oblique angle or any angle between 0 and 90 degrees.

The angle $\alpha$ of the radial centerline of a curved guide (from the middle of the guide through the point of rotation of the cantilever) with respect to the Y-axis can be about 0 degrees.

The curved deck rails, also referred to as guides, can also be placed such that the angle $\alpha$ of the radial centerline of a curved deck rail (from the middle of the deck rail through the point of rotation of the cantilever) deviates from the Y-axis. The angular position $\alpha$ of the supporting members can vary between −60 degrees (aft of the point of rotation of the cantilever) up to +60 degrees (forward of the point of rotation of the cantilever), depending on the design requirements. A preferred position is about +/−30 degrees. Both deck rails can be positioned such that their radial centerlines are both either forward or aft of the point of rotation of the cantilever. Both deck rails can be positioned such that the complete guides are both either forward or aft of the point of rotation of the cantilever.

The curved guides can have various shapes, such as a rail segment, a groove or track. The radius R2 of the centerline of the deck rail originates at the virtual point of rotation of the cantilever.

The rotating system preferably is arranged to support and allow rotation of the cantilever with respect to the deck around a vertical axis, i.e. an axis perpendicular to the plane of the deck. The rotating system can comprise a fixed rotation point, meaning fixed with respect to the vessel as the cantilever may move in its longitudinal direction, and provide rotation around a fixed predetermined rotation axis. This rotation axis can be a virtual rotation axis, i.e. no fixed locally mounted rotating shaft and/or bearing needs be mounted on the vessel at the location of the rotation axis.

In another embodiment, the rotating system can provide rotation of the cantilever without a fixed rotation axis, i.e. depending on the position of the cantilever, the rotation axis may have a different position, i.e. the rotation axis may be said to be floating with respect to vessel and with respect to the cantilever.

The deck guides or deck rails can be placed on top of a deck surface or can be embedded in a deck construction. The deck guides or deck rails can have various shapes, such as a groove, T-shaped groove, rail, track or flat; with side guides in case a fixed rotation axis is not present. The deck guides can be curved or straight. Optionally, there is provided one guide on each side of the rotation point of the cantilever, more guides on each side may be possible, e.g. when more supporting members are used. It is also possible that all guides are provided on one side of the rotation point of the cantilever. Preferably each guide is a curved T-shaped groove track, on top of the deck. Various configurations may thus be possible, e.g. two straight oblique forward deck rails with a straight aft deck rail, two straight oblique forward deck rails with a curved aft deck rail, two curved oblique forward deck rails with a straight aft deck rail or two curved oblique forward deck rails with a curved aft deck rail. The two forward deck rails can have an oblique orientation with respect to the Y-direction, or can have an angle of about 0 degrees or of about 90 degrees. It is also appreciated that the forward rails can be aft and vice versa.

When the skid boxes on the aft rail shift in transverse direction, the cantilever will turn around its point of rotation. As a result, the cantilever rail will force a forward supporting member to follow the respective forward curved guide. Transfer of these forces through the guiding parts of the top part of the supporting member can result in a slipping motion of the cantilever rail with respect to the supporting member and skewing of the cantilever rail between the guiding parts of the supporting member. Although the angled position of the curved guide improves the transfer of forces and guidance of the supporting member and reduces the risk of skewing, it can be advantageous to lock the cantilever rail in position with respect to the supporting member. This can be done by clamping means and/or holding means, such as locking of the skid unit (when present) or with a pin-hole arrangement. This arrangement results in direct force transfer from the cantilever rail to the supporting member. Slip of the cantilever rail through the upper guiding part of the supporting member and skewing of the rail can be prevented.

In another embodiment, the two deck rails of the rotating system are curved with respect to the vertical rotation axis, having a radius R2. The forward supporting member can be provided with a bottom part which is arranged to cooperate with the curved guide. This bottom part can have one or more curved guiding members, with a curvature corresponding with R2, extending alongside at least one, preferably alongside both sides, of the rail or guide. The guiding members can also be straight, provided that the guiding members offer enough play between guiding member and curved rail for the guiding member to receive the curved rail and travel.

The bottom part can have a centerline with a radius corresponding to R2 of the curved guide or curved deck rail segment, and arranged to travel along the curved deck rail. The top part of the supporting member is arranged to receive and hold a cantilever rail and allow the cantilever to move through in the longitudinal direction of the cantilever. The top part can be configured with a skid unit for actively effectuating movement of the cantilever. Such a skid unit can be actuated with hydraulic cylinders or rack & pinion. The top part can be configured with or without skid unit. The movement of the cantilever may then have to be induced by other actuating means, such as the other or opposite supporting members.

Preferably, the two curved deck rails have a radius of curvature with respect to the vertical rotation axis, such that by moving the cantilever over the two deck rails of the rotating system, the rotation movement is obtained. Advantageously, the deck rail of the supporting structure is curved with respect to the vertical rotation axis, having a radius R1. Such that, by moving the cantilever over the deck rails, rotation about the vertical axis is obtained. The deck rail of the supporting structure can also be straight, preferably extending in the Y direction. The distance to the vertical rotation axis can then be referred to as D1, which is the distance between the deck rail and the rotation axis. Preferably, the radius R1, or the distance D1, is larger than the radius R2, in particular when the deck rail of the supporting structure is mounted aft of the deck and when the rails of the rotating structure are mounted at an opposite side of the deck rail, at a more forward position on the deck, such that by rotating the cantilever around the vertical rotation axis, a relatively large displacement of the cantilever at the aft end can be obtained.

The invention further relates to an offshore system comprising a platform, such as a vessel or a jack-up, having a deck a cantilever mountable on the deck and movable with respect to the deck of the platform; a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis; such that the cantilever is movable between a retracted position in which it substantially is above the deck, and an extended position in which it is substantially extended outside of the deck; wherein the skidding system comprises a pair of longitudinal cantilever rails mounted to a bottom side of the cantilever, and at least a pair of skid shoes mountable on the deck, wherein a top part of the skid shoe is arranged to receive and guide a cantilever rail; wherein the top part of the skid shoe is configured to allow the cantilever rail to have an angle deviating from the centerline of the skid shoe during rotation of the cantilever.

By providing such a skid shoe, the free height between the cantilever and the deck may become less. Also, since the skid shoe is preferably fixedly mounted onto the deck, the deck rails may be obviated. A possible configuration may for example comprise an aft deck rail oriented in Y-direction on the deck and two forward mounted skid shoes that are mounted on the deck in a symmetrical fashion with respect to the X-direction of the deck. On the deck rail, at least two supporting members may be arranged to engage the longitudinal cantilever rails with the deck rail and to support the cantilever. The supporting members may be actuated by a skid unit, such that the supporting members are driving the movement of the cantilever, whereas the forward skid shoes are being driven, or follow, the movement of the cantilever and therefore facilitate the cantilever translational and rotational movement.

Rotation of the cantilever can be achieved by moving the aft supporting members on the aft deck rail. The forward skid shoes are in a fixed position, which means the cantilever rails will move through the skid shoes but cannot move sideways at the position of the skid shoe, resulting in the cantilever rail having an angle deviating from the centerline of the skid shoe, or from the centerline of the top part of the skid shoe. Therefore, the skid shoe can be arranged to prevent locking of the rail in the skid shoe due to skewing if the cantilever rail deviates relative to the skid shoe center line. The skid shoe can therefore be arranged to allow the cantilever rail to have an angle deviating from the centerline of the skid shoe by providing sufficient play between rail and guiding elements and/or by providing a curved guiding element alongside at least one side, preferably along both sides, of the cantilever rail. Each guiding element can comprise an arc shape or e.g. a V-shape which is closer to the rail at its middle and further outwardly from the rail at the ends of the skid shoe.

With for example 10-40 mm play available on each side of the rail, the rail can have an angle of at least 5 degrees deviating from the centerline of the skid shoe and the centerline of the vessel or jack-up.

Optionally the skid shoe includes hinged guiding elements for guiding the cantilever rail. The hinged guiding elements are arranged for rotation about a vertical axis. The hinged guiding element provide a larger supporting surface along the longitudinal direction of the cantilever rail.

Instead of aft supporting members on an aft rail, the cantilever can also be supported by aft skid shoes. These skid shoes will have different dimensions regarding the required play between the rail and the guiding elements and regarding the curved guiding elements to accommodate the rail at an angle deviating form the centerline of the vessel or jackup, because the (floating) rotation point of the cantilever will lie between the forward skid shoes. The aft skid shoes can be provided with a skid unit, for example of the rack and pinion type, to effectuate longitudinal movement of the cantilever.

Rotation of the cantilever can be achieved by actuating only the skid unit(s) on one side of the cantilever, or by actuating the skid units on one side at a different rate as the skid units on the other side.

The invention further relates to a supporting member comprising a bottom part arranged to engage a deck rail and a top part arranged to engage a cantilever rail, wherein the top part and/or the bottom part are configured to allow off-centerline movement of the respective rail engaged with the top and/or bottom part respectively with respect to the centerline of the top and/or bottom part respectively. Preferably, the top part and the bottom part have an oblique angle with respect to each other.

The invention further relates to a skid shoe comprising a bottom part arranged for fixedly mounting on the deck, and a top part arranged to engage a cantilever rail, wherein the top part of the skid shoe is configured to allow the cantilever rail to have an angle deviating from the centerline of the skid shoe.

The invention further relates to a rotating system comprising a coupling member such as a yoke providing a coupling between the deck at the bottom side and between the cantilever rails at the top side. The coupling member can be mounted onto a fixed rotation shaft acting as the rotation axis, in such an embodiment, the forward deck rails may be obviated. Typically, the rotation axis is positioned at a more forward location with respect to the aft side of the platform. The coupling member can be embodied as a connecting beam rotatable around the vertical rotation axis, without the presence of a physical rotation shaft. In this embodiment, the coupling member may move over the forwardly positioned deck rails to allow for rotation of the cantilever. The top side of the coupling member and/or the bottom side of the coupling member may be provided similar to the top part and/or the bottom part of the supporting member previously described.

In order to further improve the alignment or the supporting members, a rotation axle (or shaft) fixed to the deck can be provided. This fixed physical rotation axle and possibly an additional reaction arm can further assist in counteracting the reaction forces. The connecting beam may be provided between supporting members, preferably to align supporting members and/or to take up reaction forces. The connecting beam may further be provided with additional arm(s), to transfer the pushing force of the cantilever rail, which occurs when skid boxes on the aft rail move in transverse direction, directly to the supporting member.

Optionally, only a single forward deck rail segment may be provided, instead of two, arranged to guide one or more forward supporting members supporting the cantilever. Also, a single forward supporting member can be provided which supports both cantilever rails and can travel along a curved rail segment. The top part of this supporting member can be a beam or a yoke with a the top side configured to facilitate longitudinal movement of the cantilever. The supporting member can also have two top parts to cooperate with the cantilever rails, which are connected with a beam. This beam is positioned on top of the bottom part of the supporting member which can travel along the curved guide or rail segment.

The cantilever can be supported by at least one supporting member placed on an aft deck rail or on aft deck rail segments. The aft deck rail can be a straight or curved rail on deck or at the stern or transom. A curved deck rail is especially suitable for a ship shaped jack-up with a curved transom, because of structural advantages. The radius of the curved aft rail R1, or the distance D1 of the straight aft rail, can be larger than radius R2 of the forward curved guide(s), but both originate in the (virtual) point of rotation of the cantilever.

Further advantageous embodiments are represented in the subclaims.

DETAILED DESCRIPTION OF THE INVENTION

The invention will further be elucidated on the basis of exemplary embodiments which are represented in a drawing. The exemplary embodiments are given by way of non-limitative illustration.

Figure 11A:
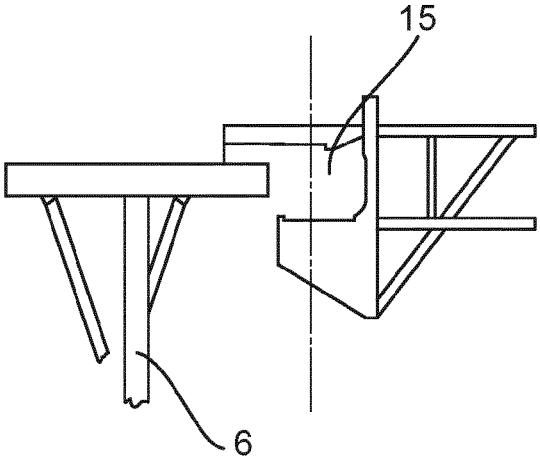
Figure 11B:
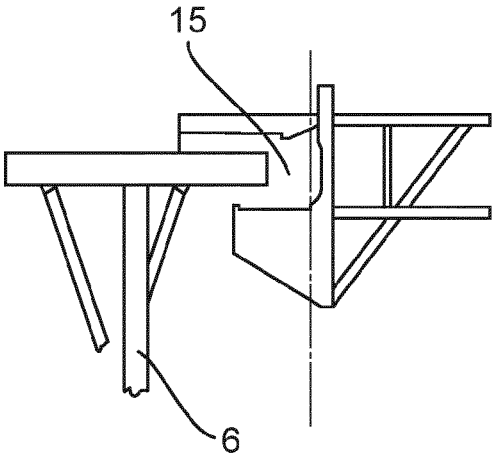
Figure 11C:
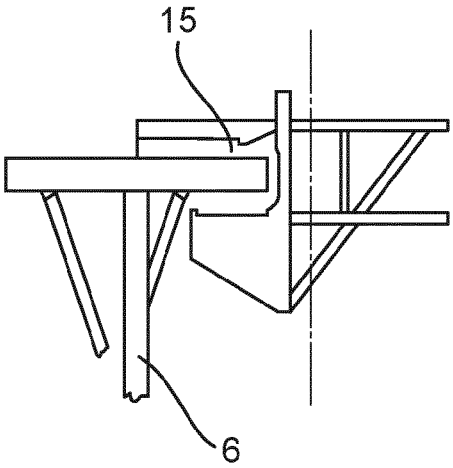
Figure 11D:
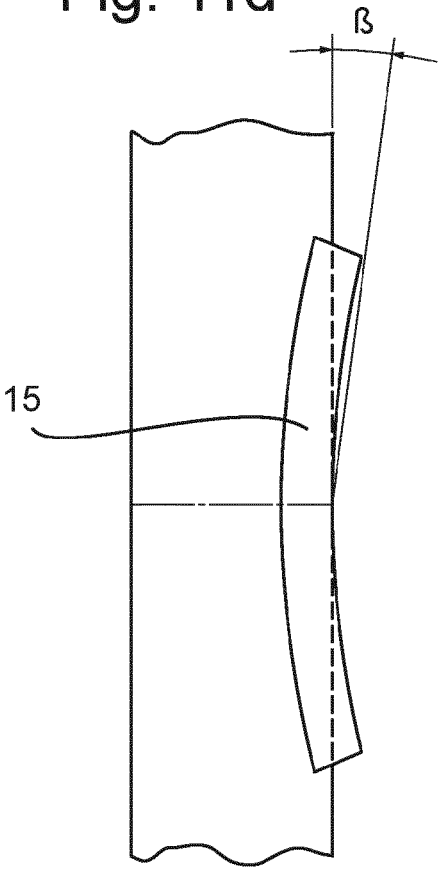

FIGS. 11*a*, 11*b*, 11*c*, 11*d* show a schematic side view (FIGS. 11*a*, 11*b*, 11*c*) of a deck rail being guided through a bottom part of a supporting member, as seen in the top view of FIG. 11*d;*

Figure 12A:
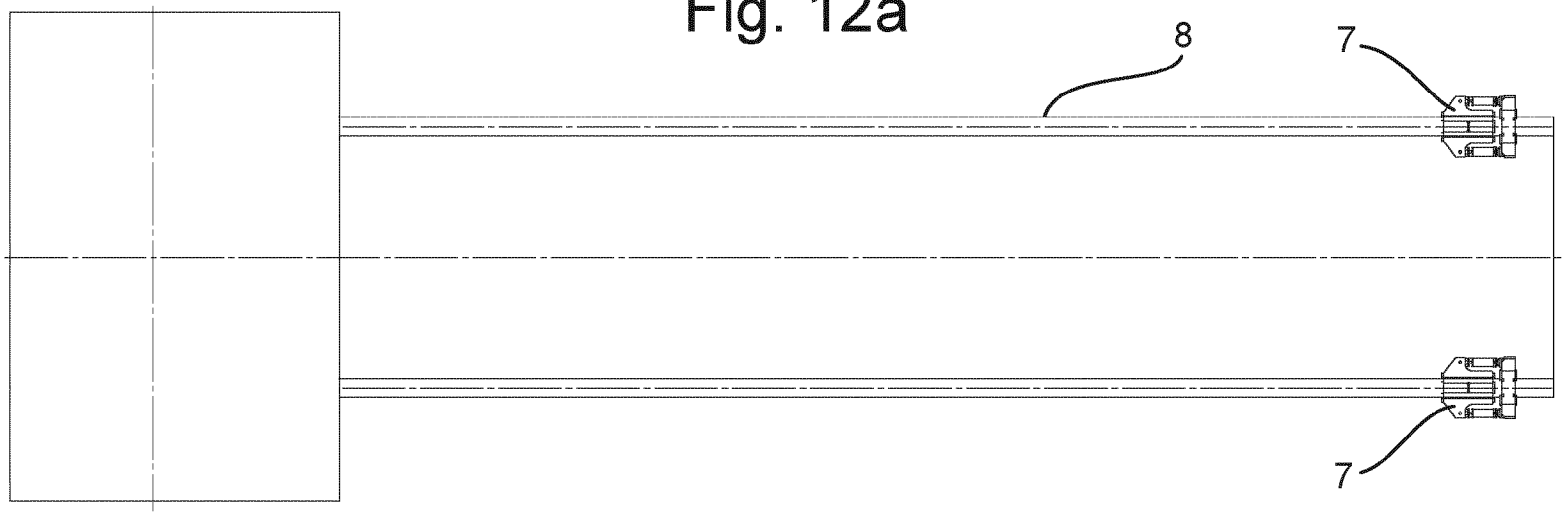
Figure 12B:
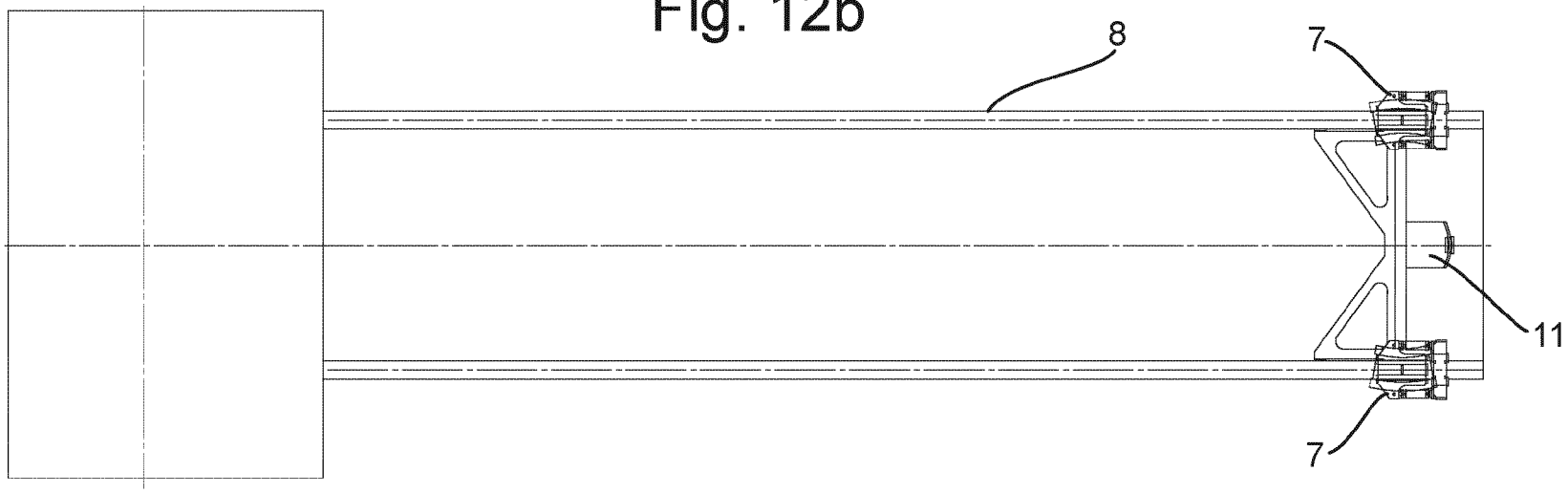
Figure 13A:
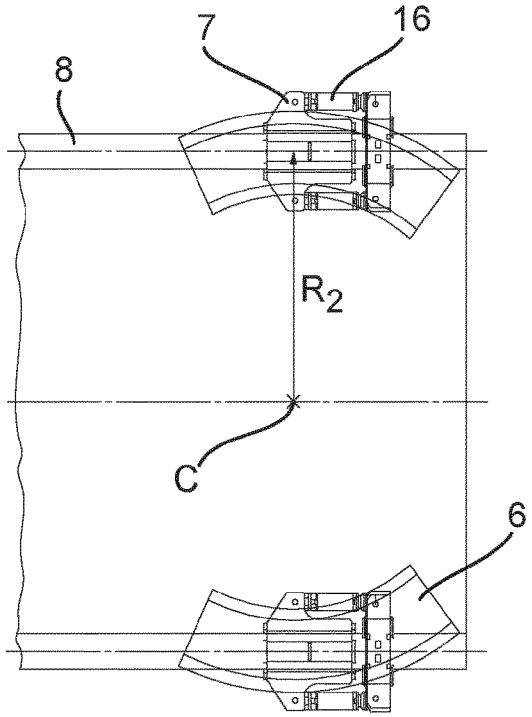
Figure 13B:
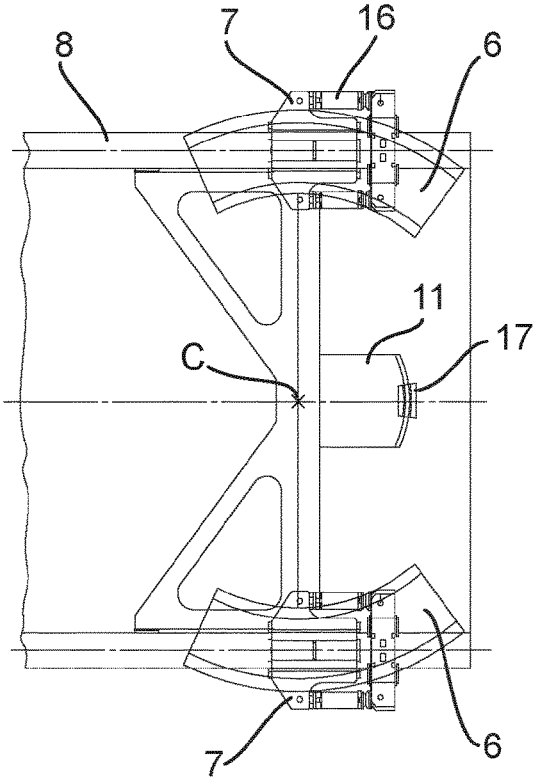
Figure 13C:
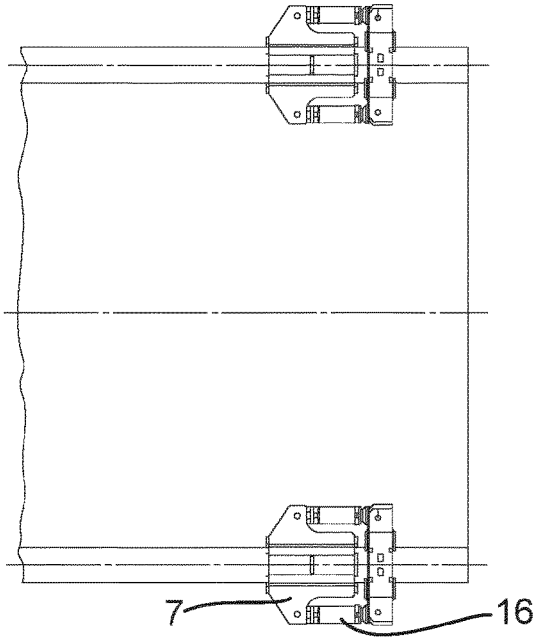
Figure 14:
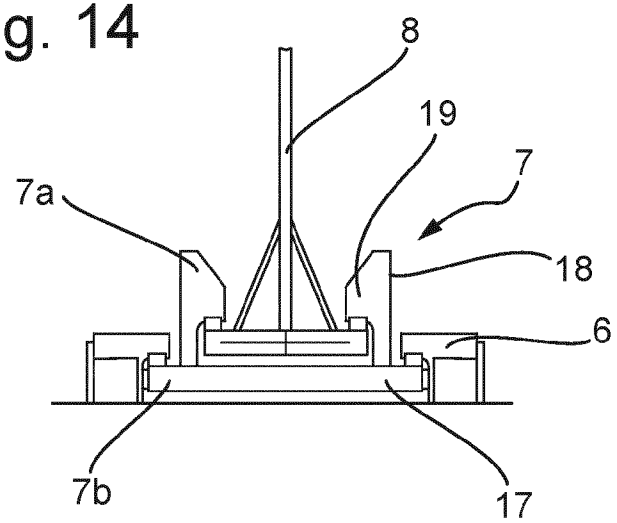
Figure 15:
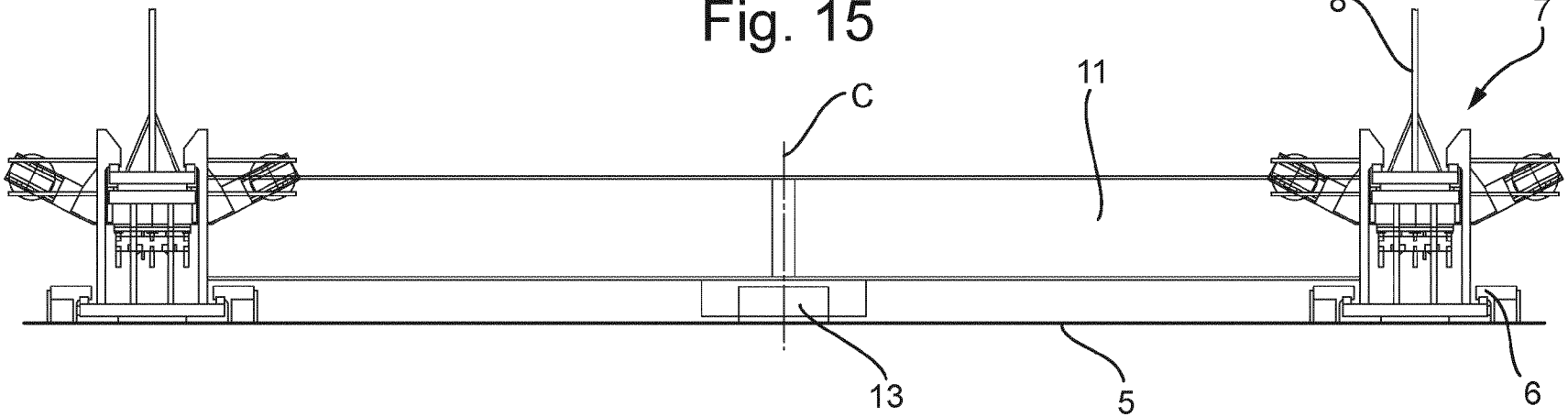
Figure 16:
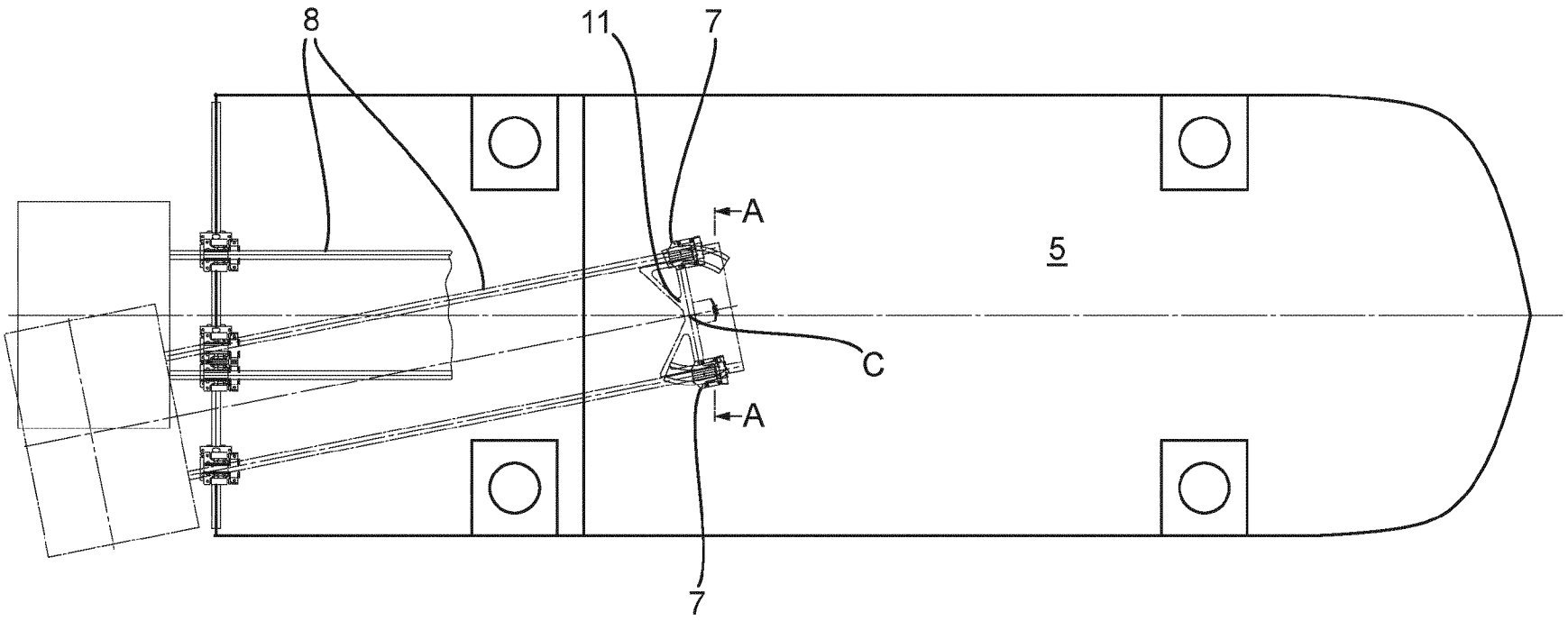
Figure 17:
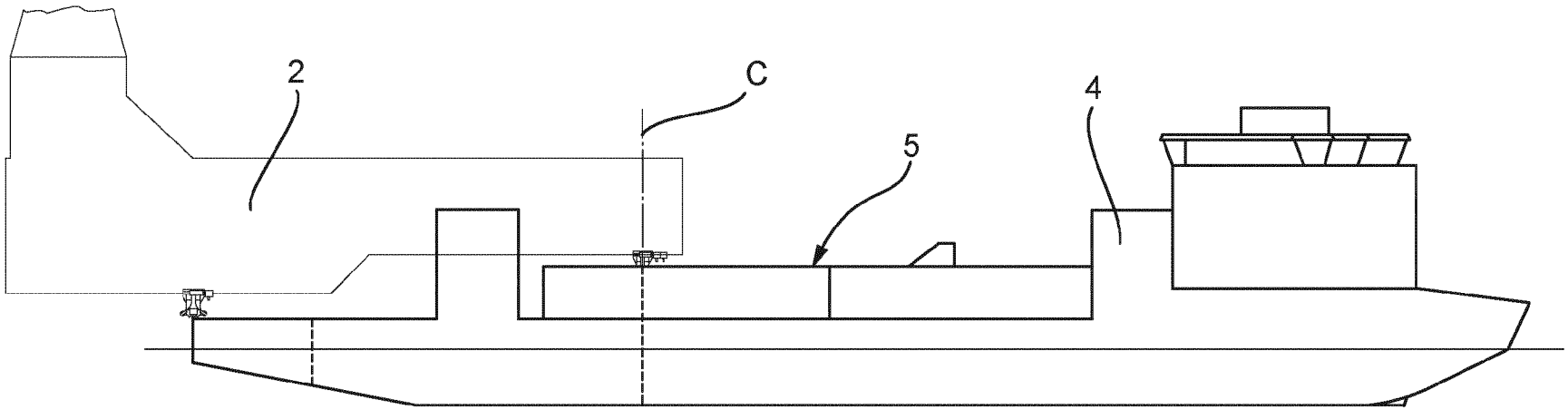
Figure 18:
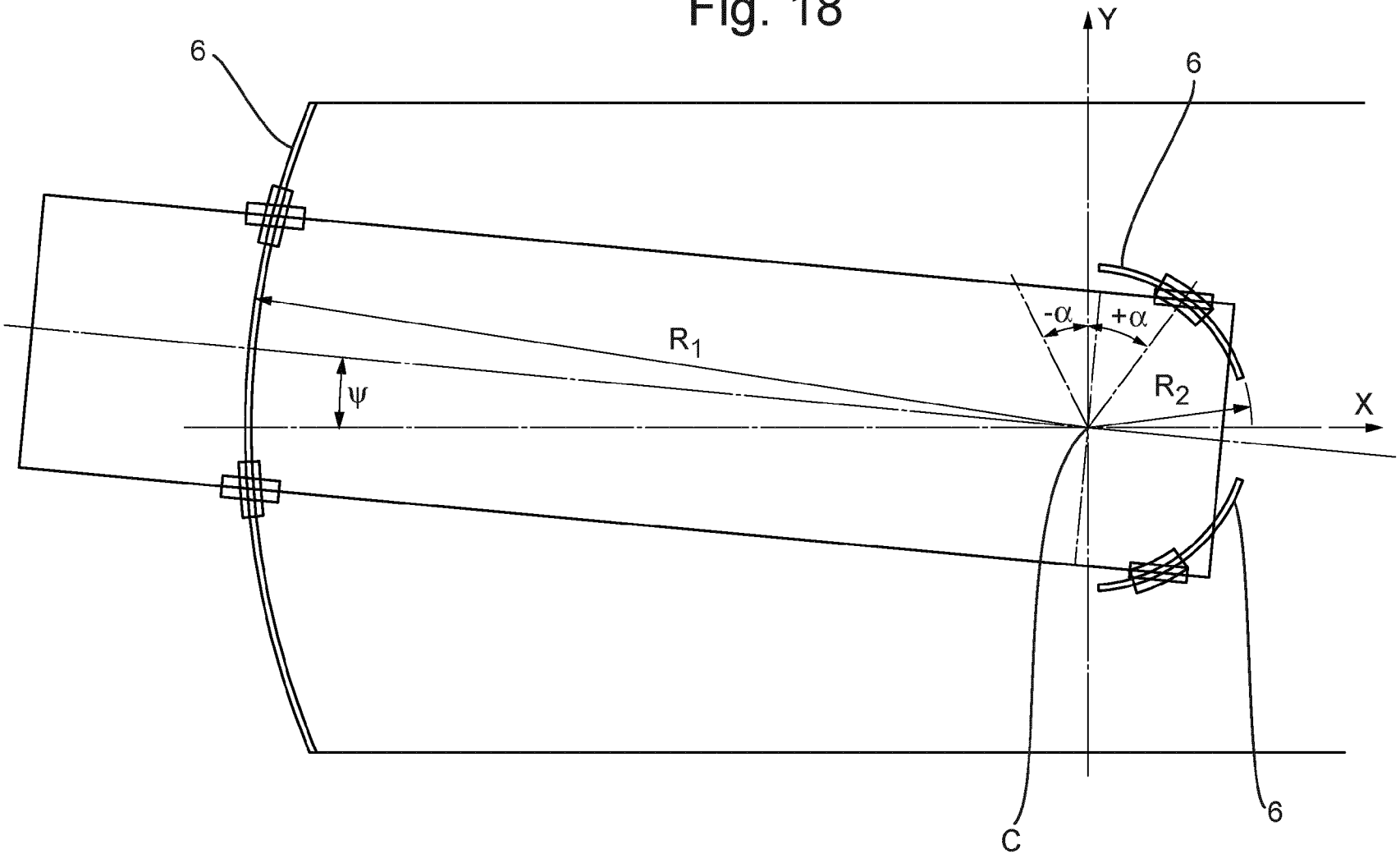
Figure 19A:
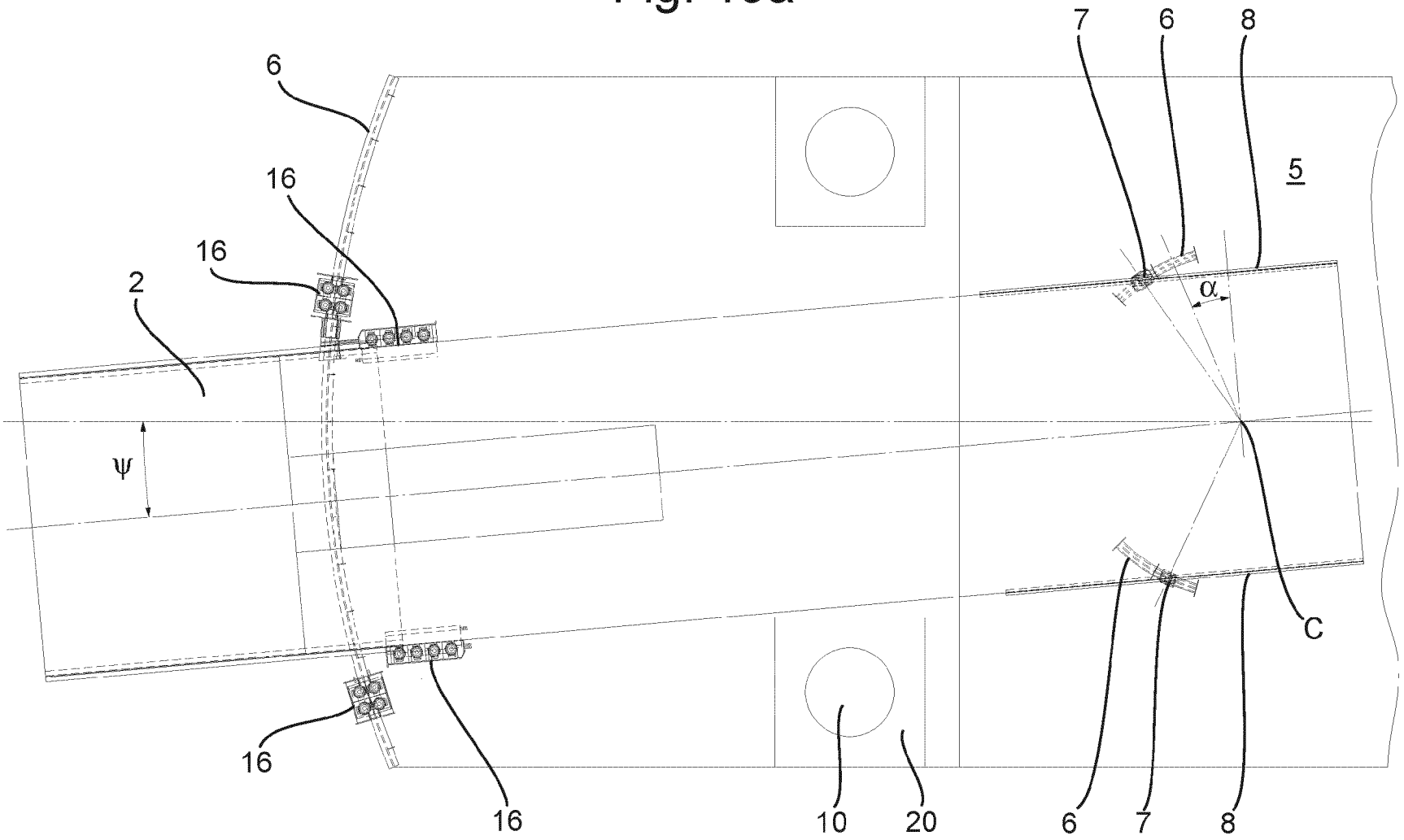
Figure 19B:
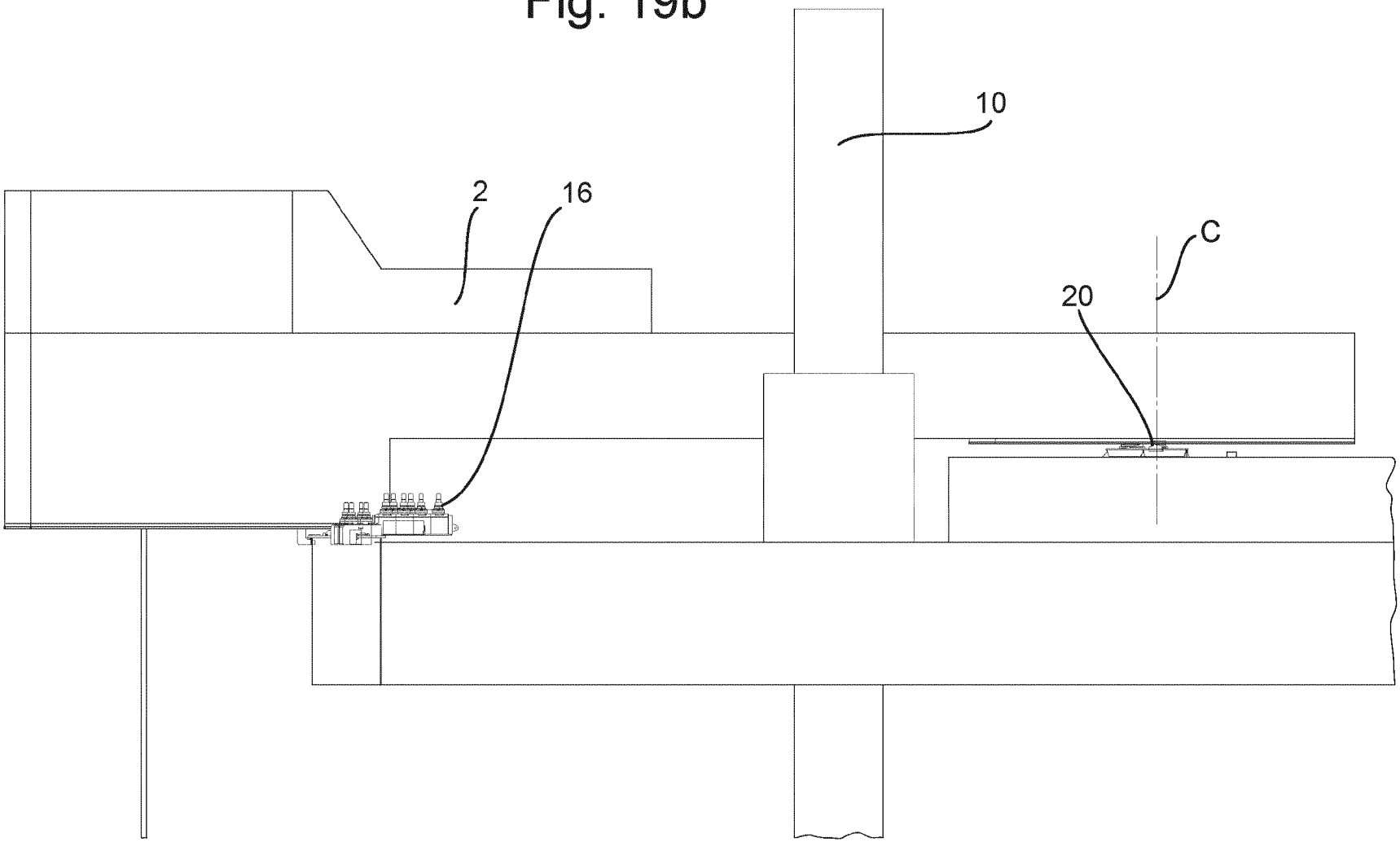

FIG. 12*a* shows a schematic top view of an embodiment of a skidding system comprising two longitudinal cantilever rails and two forward positioned supporting members;

FIG. 12*b* shows a schematic top view of an embodiment of a skidding system comprising two longitudinal cantilever rails with two forward positioned supporting members and a coupling member;

FIG. 13*a* shows a detail of the forward supporting members of the embodiment of FIG. 12*a* having a fixed vertical rotation axis;

FIG. 13*b* shows a detail of the forward supporting members with coupling member of the embodiment of FIG. 12*b* having a fixed vertical rotation axis;

FIG. 13*c* shows an embodiment of supporting members with a floating rotation axis;

FIG. 14 shows an embodiment of a supporting member of which a bottom part is engaged with a deck rail and a top part is engaged with a cantilever rail;

FIG. 15 shows a schematic cross-sectional view of the rotating system of FIG. 16 along the line A-A;

FIG. 16 shows a schematic top view of an offshore structure with an embodiment of a skidding system with the cantilever in a straight position, in which the centerline of the cantilever is aligned with the centerline of the platform, and in rotated position;

FIG. 17 shows a side view of the offshore structure of FIG. 16;

FIG. 18 shows a schematic top view of an aft side of the platform with the cantilever mounted thereon and an embodiment of a skidding system;

FIG. 19*a* shows a schematic top view of an offshore structure with an embodiment of a skidding system with a curved aft deck rail and two curved forward deck rails around a virtual rotation axis, comprising skid units;

FIG. 19*b* shows a schematic side view of the embodiment of FIG. 19*b;*

Figure 20A:
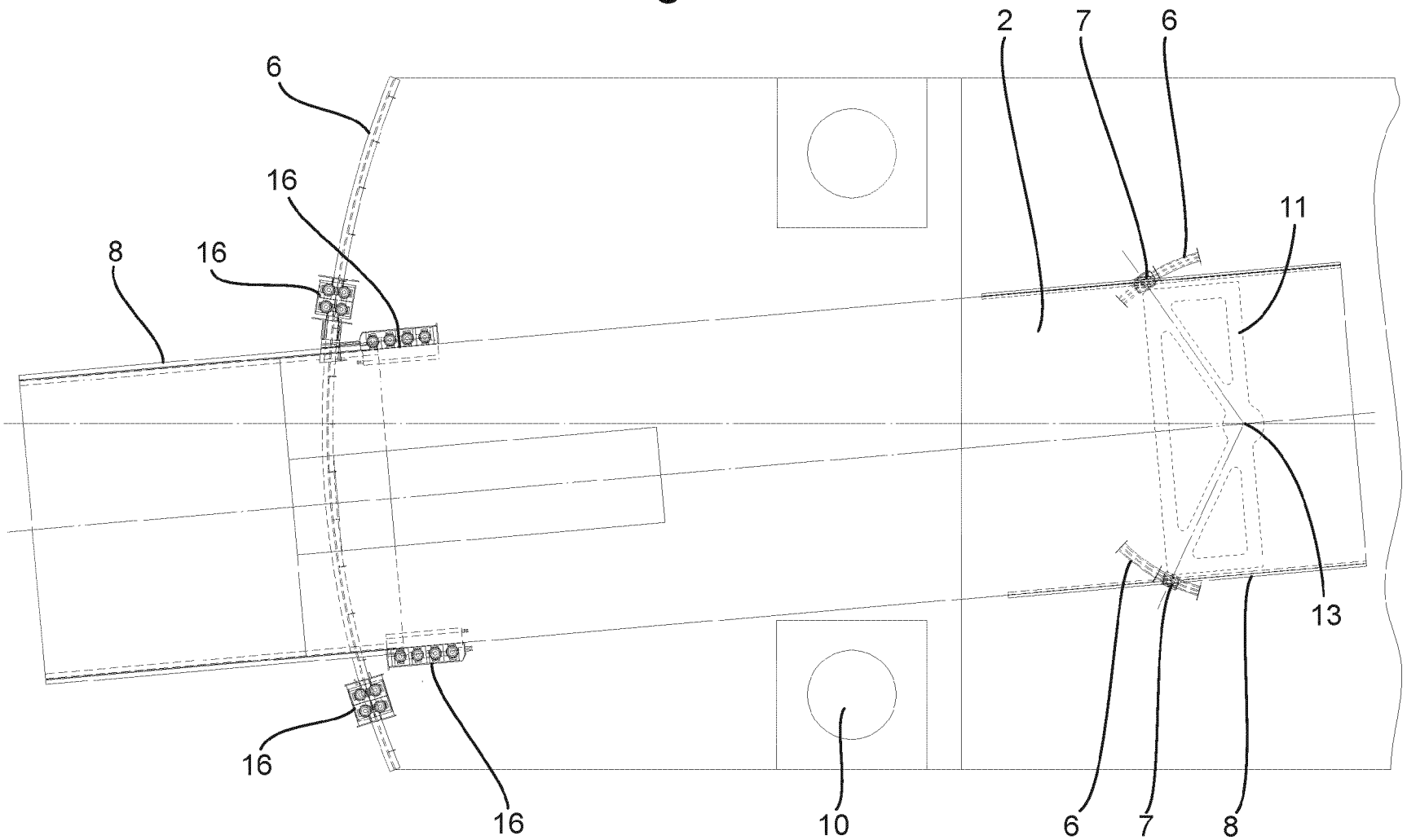
Figure 20B:
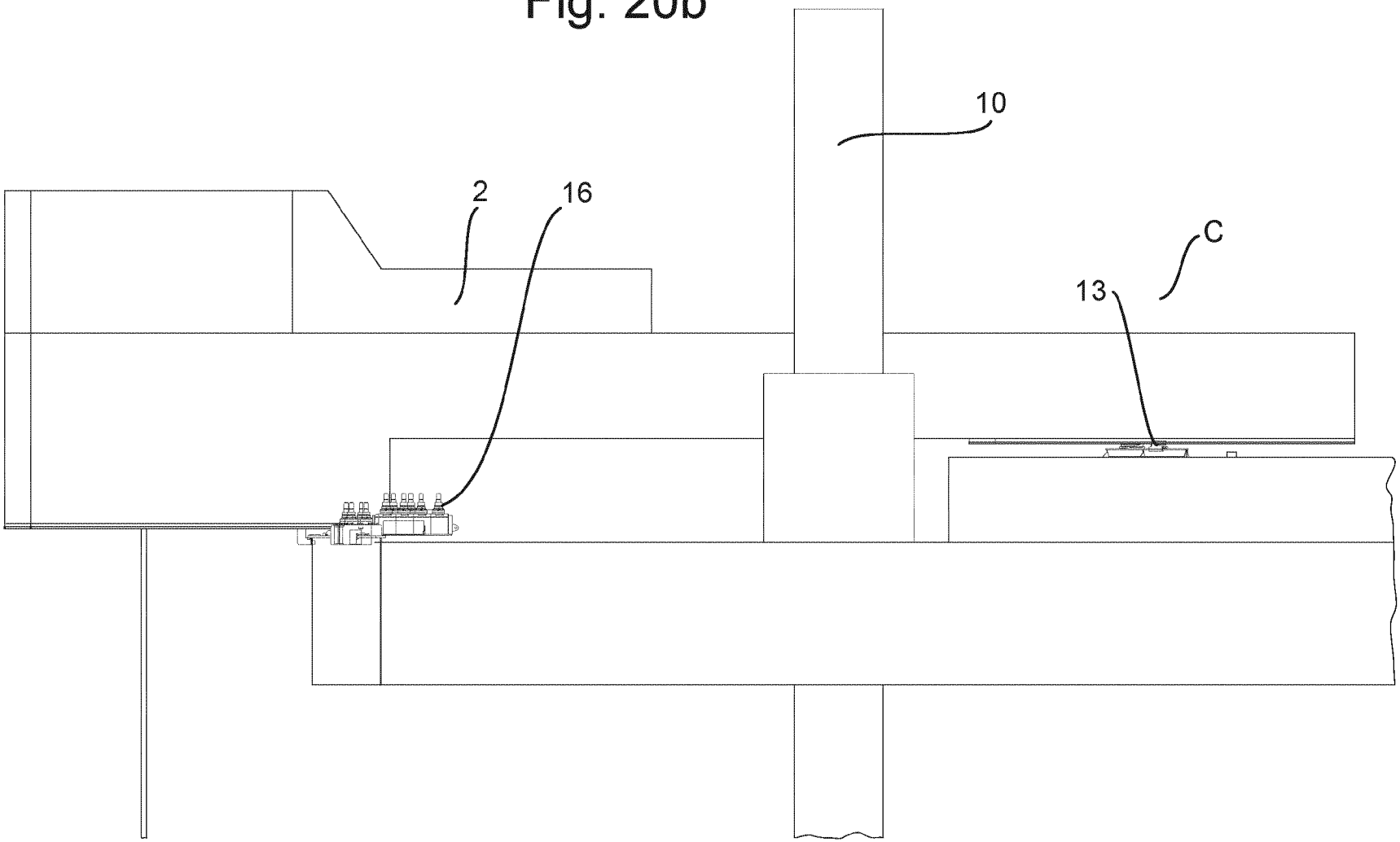

FIG. 20*a* shows a schematic top view of an offshore structure with an embodiment of a skidding system with a curved aft deck rail and two curved forward deck rails around a rotation shaft with a coupling member, comprising skid units;

FIG. 20*b* shows a schematic side view of the embodiment of FIG. 20*b;*

Figure 21:
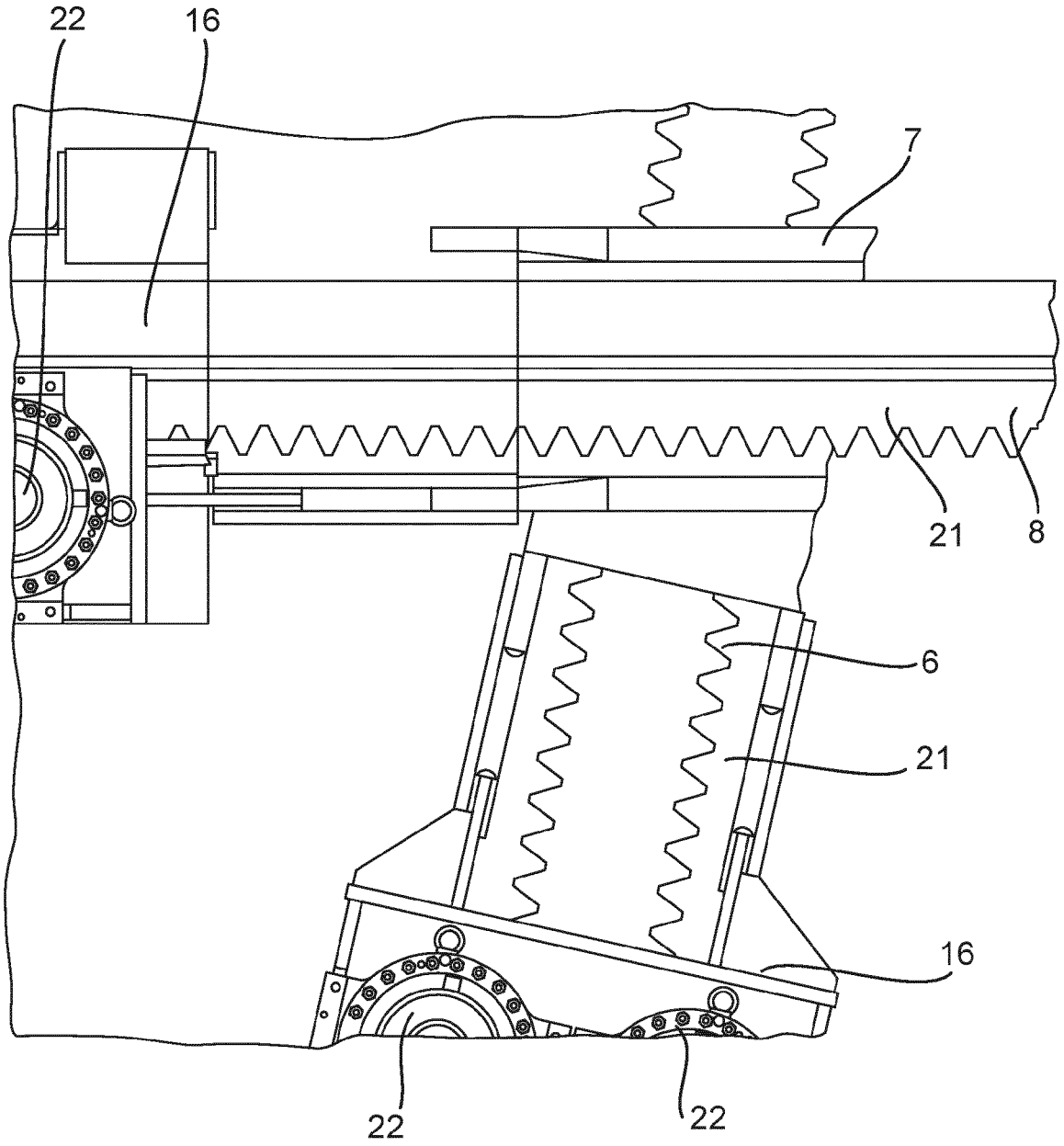
Figure 22A:
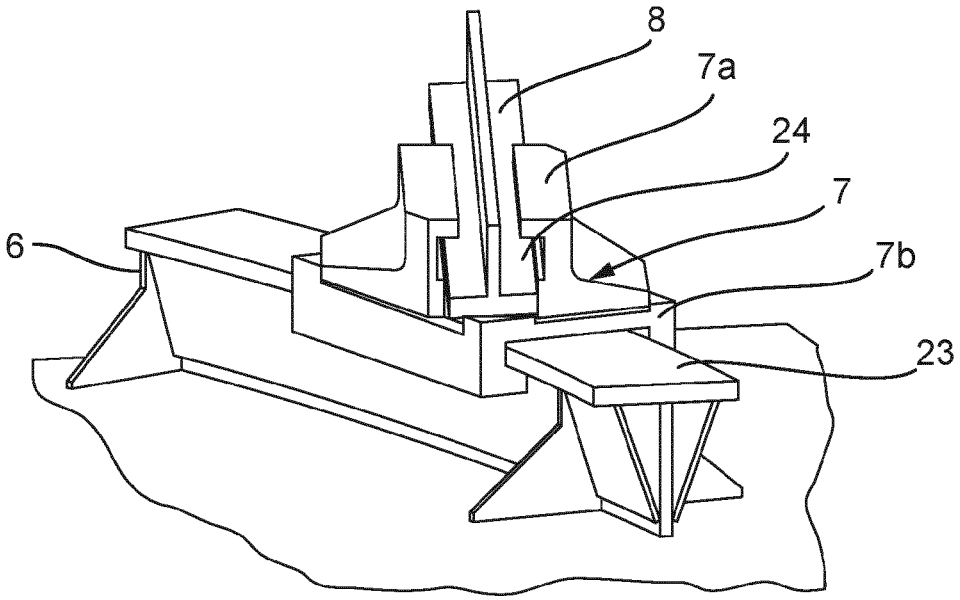
Figure 22B:
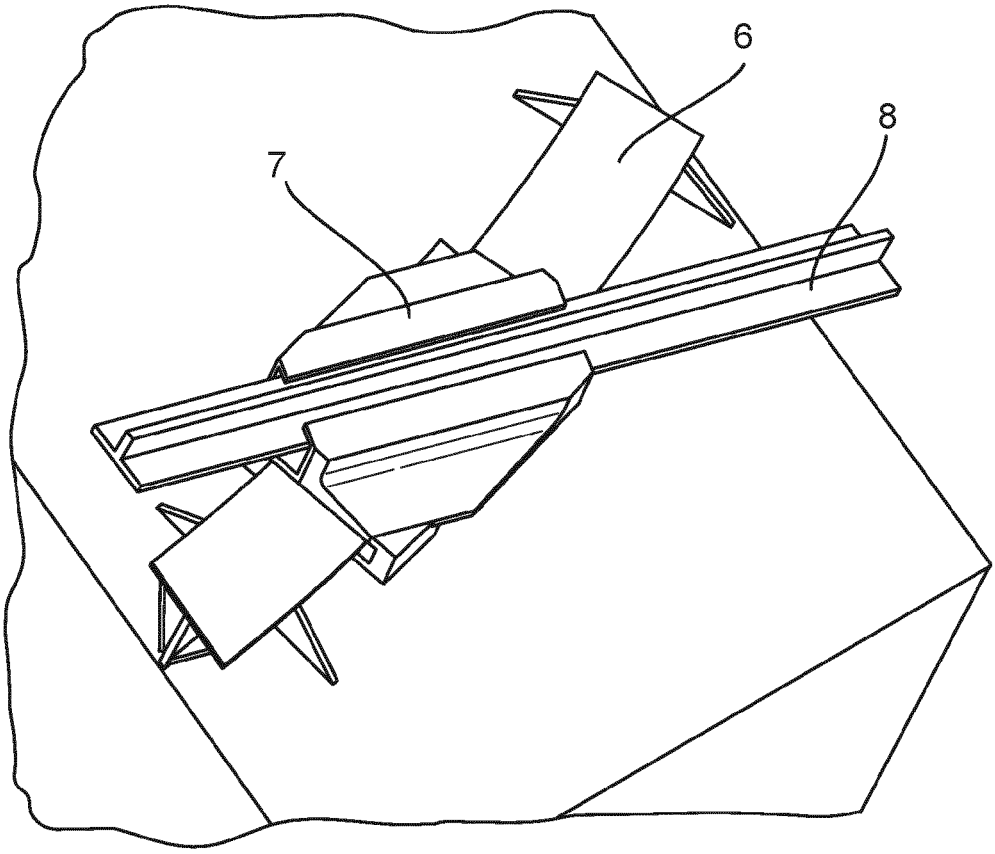
Figure 23A:
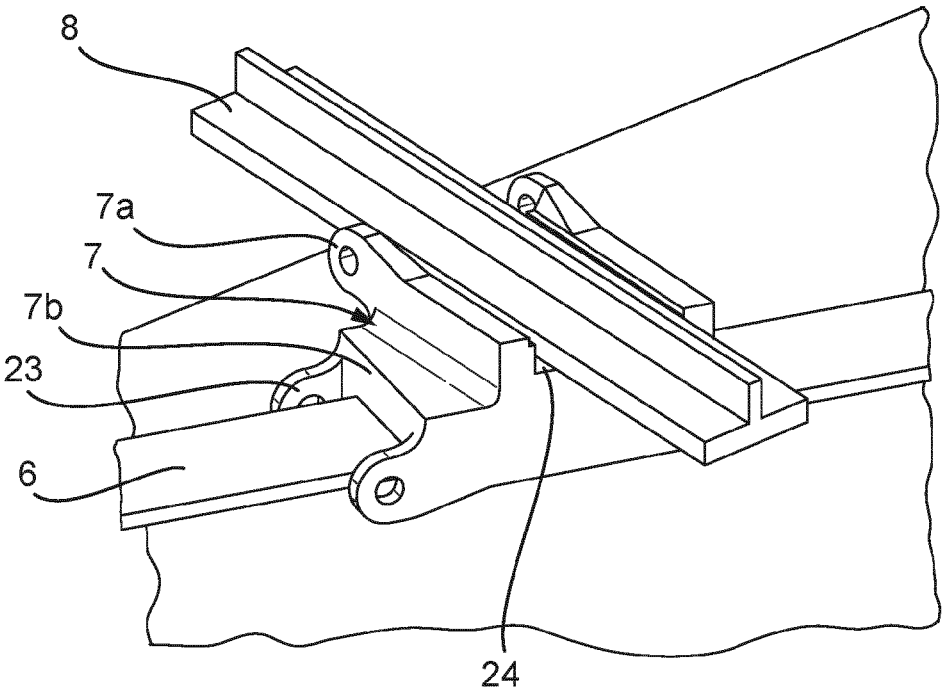
Figure 23B:
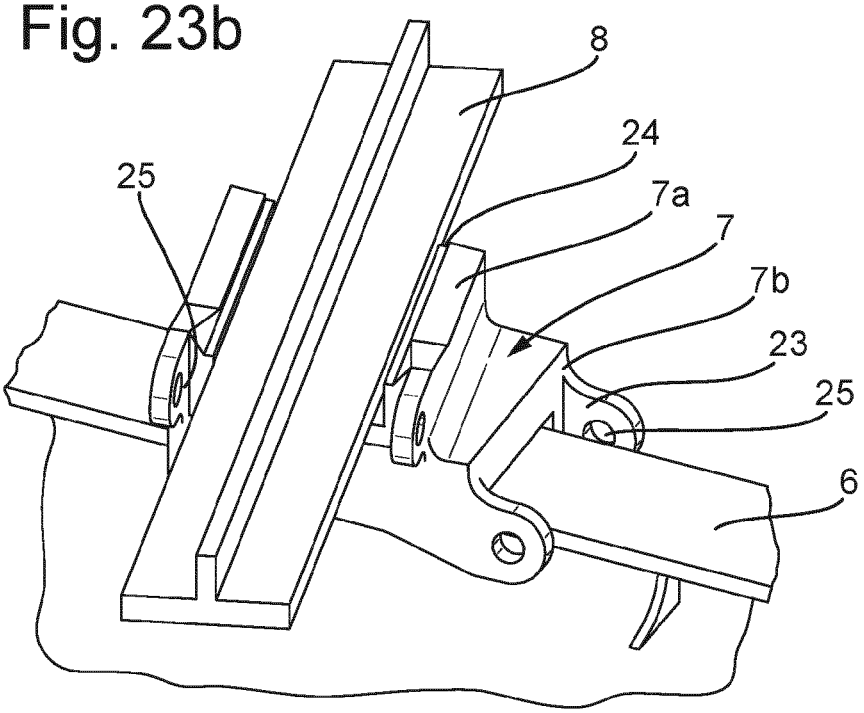
Figure 24A:
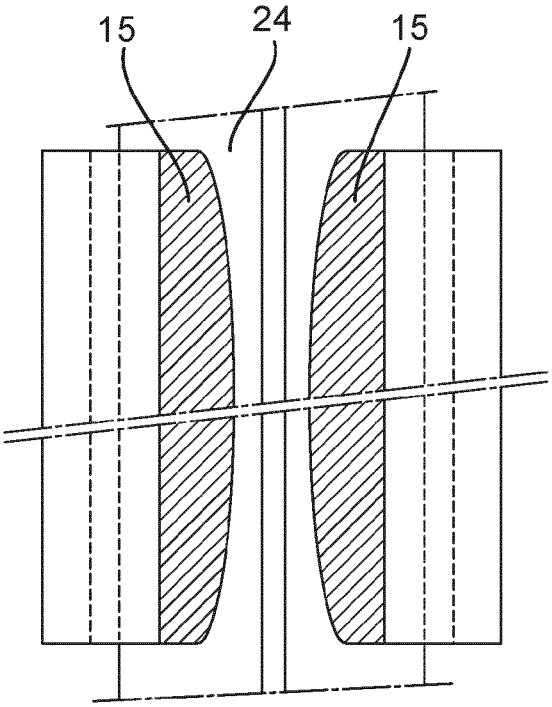
Figure 24B:
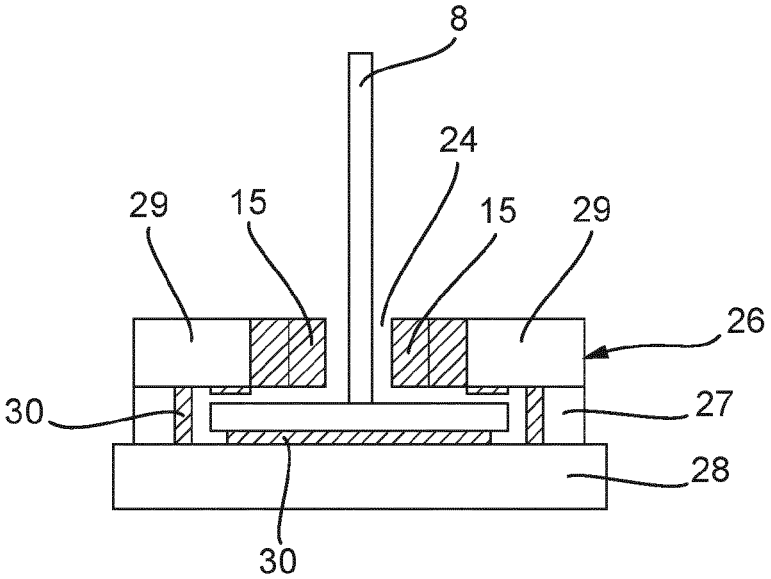
Figure 25A:
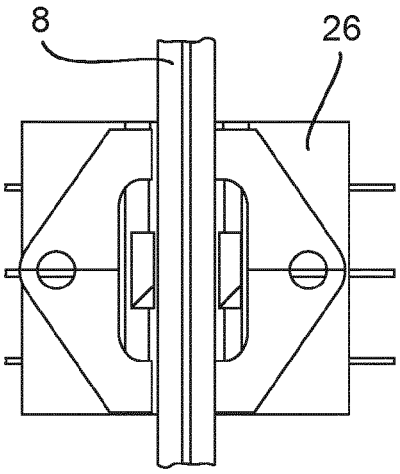
Figure 25B:
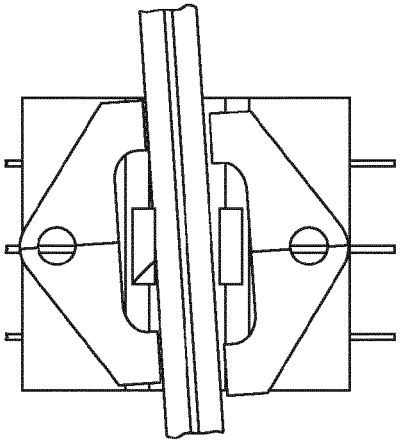
Figure 25C:
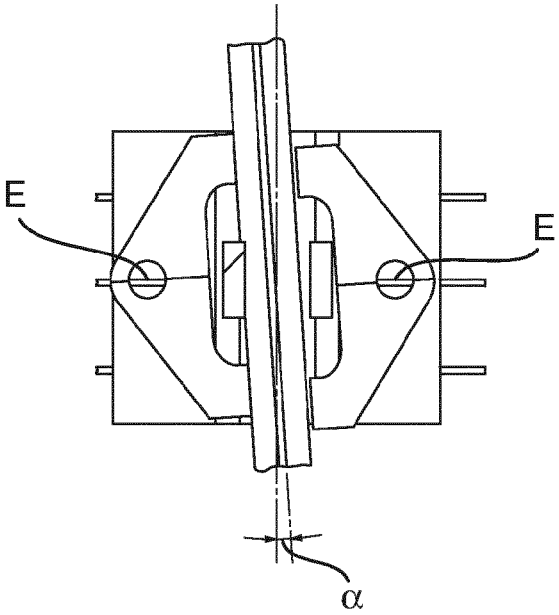
Figure 25D:
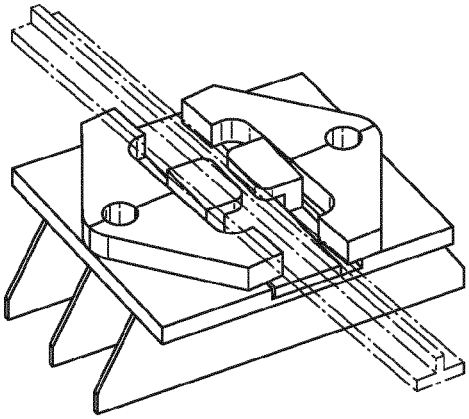

FIG. 21 shows a schematic top view of a rack and pinion system as skid unit;

FIGS. 22*a* and 22*b* show a schematic perspective side view and top view respectively of an embodiment of a forward curved deck rail with supporting member thereon and a portion of the cantilever rail;

FIGS. 23*a* and 23*b* show a schematic perspective side view and top view respectively of an embodiment of an aft curved deck rail with a supporting member thereon and a portion of the cantilever rail;

FIGS. 24*a* and 24*b* show a schematic top view and side view respectively of an embodiment of a skid shoe;

FIGS. 25*a*, 25*b*, 25*c* show a schematic top view of a skid shoe having adjustable guide elements;

FIG. 25*d* shows a schematic perspective view of the skid shoe of FIGS. 25*a*, 25*b*, 25*c*.

It is noted that the figures are only schematic representations of embodiments of the invention that are given by way of non-limiting example.

Various modifications, variations, and alternatives are possible, as well as various combinations of the features described. The specifications, drawings and examples are, accordingly, to be regarded in an illustrative sense rather than in a restrictive sense.

In general, the skidding system 1 for moving a cantilever 2 with respect to a deck 3 of a platform 4, such as a vessel or a jack-up, comprises one or more guides on a deck 5, also called deck rails 6 for directing movement of supporting members 7 with respect to the deck 5. The deck rails 6 can be positioned on either side, forward or aft, of the point of rotation C of the cantilever 2. The cantilever 2 itself is at its bottom side provided with longitudinally extending guides or cantilever rails 8. In the embodiments shown here, the offshore structure 9 comprises a platform 4, a cantilever 2, and three or four legs 10 that are adjustable with respect to the platform 4 in a well-known manner.

The centerline of the platform 4 vessel is the X-direction. The Y-direction is perpendicular to the X-direction in the horizontal plane. The rotation axis extends in a vertical Z-direction, perpendicular to the deck plane of the X- and Y-direction.

Further, the skidding system 1 for moving a cantilever 2 with respect to a deck 5 may comprise one or more supporting members 7, also called skidboxes, each interacting with at least one of the longitudinal rails 8 and at least one of said deck rails 6. Each supporting member 7 or skidbox comprises: an top part arranged to allow the cantilever 2 to move along the longitudinal rails 8 and/or to hold the cantilever in position; and a bottom part arranged to move along the deck rails 6.

Figure 1:
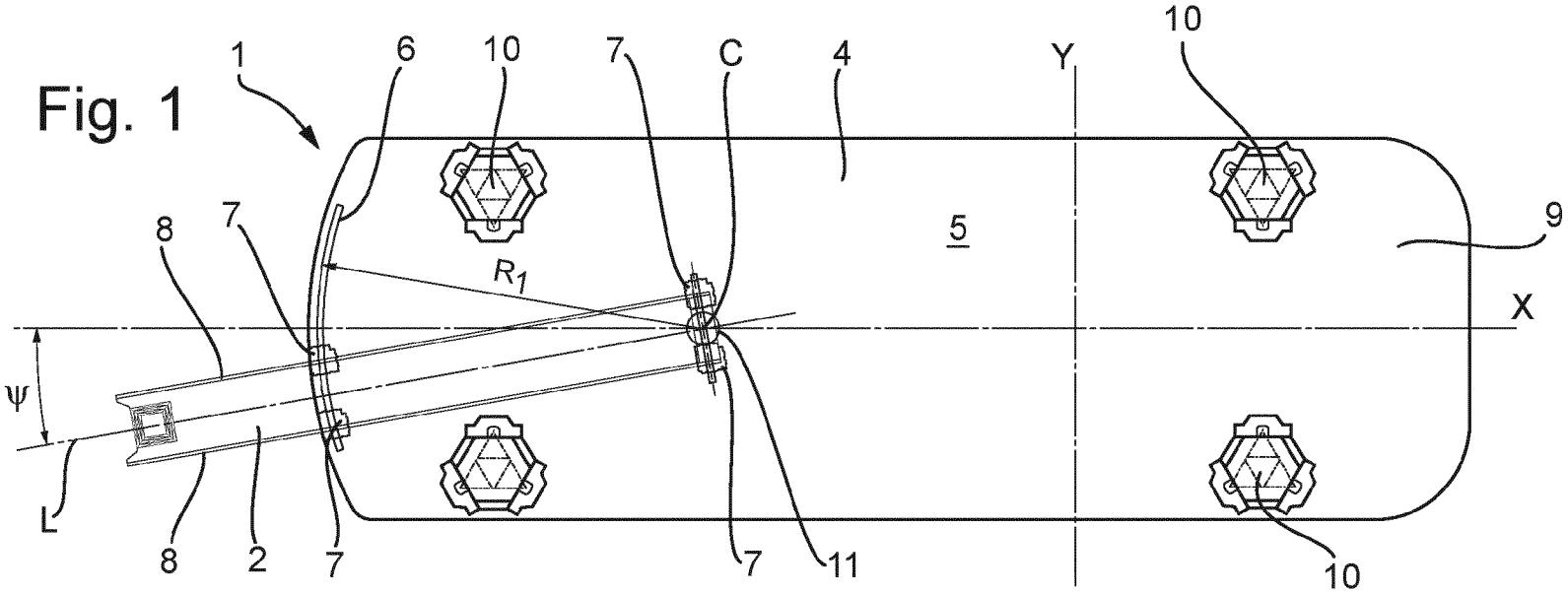
FIG. 1 shows a schematic top view of an offshore structure with cantilever and an embodiment of a skidding system with a fixed rotation shaft, with the cantilever in extended position.
Figure 2:
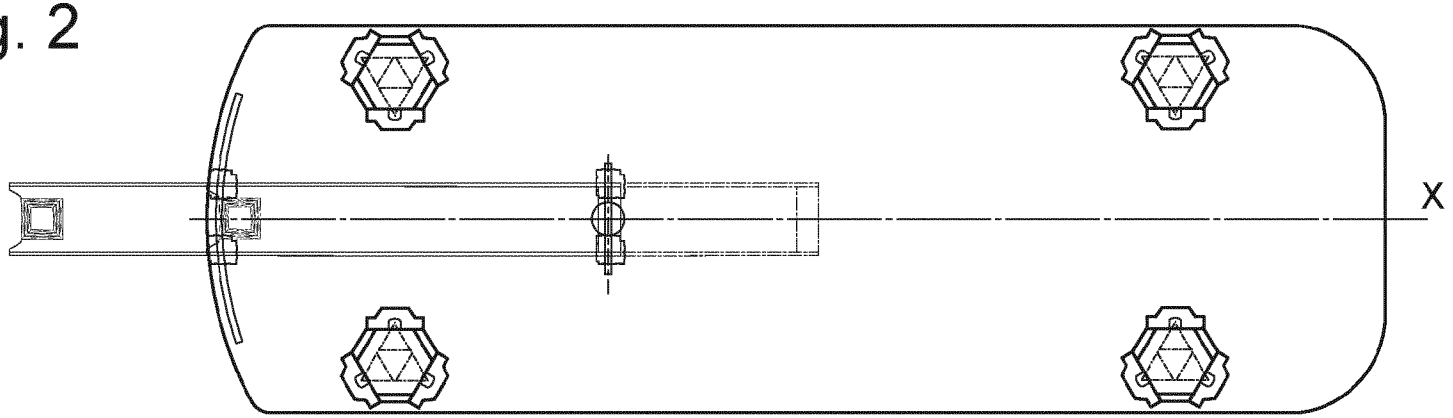
FIG. 2 shows a schematic top view of the embodiment of FIG. 1 with the cantilever in retracted position.
Figure 5:
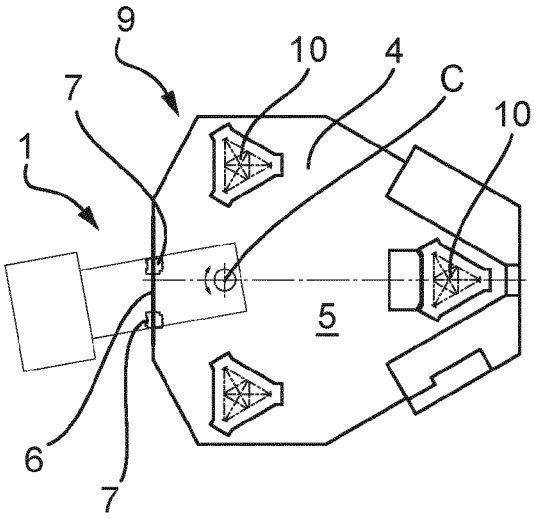
FIG. 5 shows a schematic top view of an embodiment of an offshore structure with a skidding system with a fixed rotation shaft with the cantilever in extended position.
Figure 6:
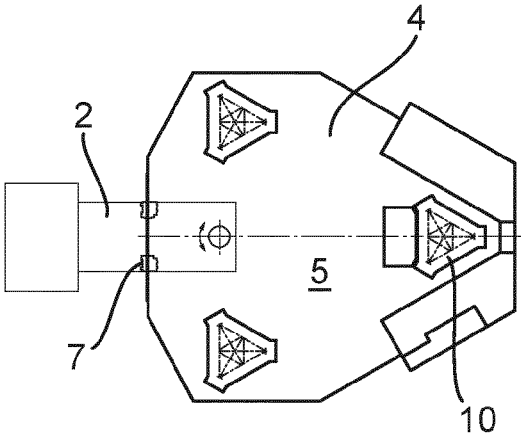
FIG. 6 shows a schematic top view of the offshore structure of FIG. 5 with the cantilever in longitudinal extended position.

In the embodiments of FIGS. 1 and 2, a curved aft deck rail 6 is provided, whereas in the embodiments of FIGS. 5 and 6 a straight aft deck rail 6 is provided.

Further, the supporting member 7 comprises holding means or clamping means to hold said rail which it interacts with, e.g. guide elements, or means provided to the said rail or guide to hold the supporting members/skidboxes it interacts with.

In the embodiment of FIGS. 1-7, a connecting beam 11 is provided between placed apart supporting members 7 at one end of the cantilever 2, here the forward end, for example between the aft supporting members or between the forward skidboxes. Advantageously, as here in FIGS. 1-7, the skidboxes 7 are arranged on both sides of the point of rotation C of the cantilever 2. By providing a connecting beam 11, the supporting members 7 may be kept aligned and at the same distance with respect to each other. The connecting beam 11 may also take up reaction forces and/or other loads.

The rotating system 12, in the embodiments of FIGS. 1-7 comprising a connecting beam 11, may have a fixed rotation point or rotation axis C, wherein a pivoting structure, such as a bearing 13, may be fixed to the deck 5 positioned at the point of rotation of the cantilever, e.g. at the crossing of centerlines of the cantilever and the connecting beam, to keep the supporting members 7 aligned with respect to the deck rails 6.

A holding member is arranged to allow at least one supporting member 7 to move along the deck rail and/or cantilever rail and to hold the supporting member 7 in place in case vertical pulling loads are exerted to the supporting member 7, e.g. when the cantilever 2 is in extended position. The supporting member 7 can be arranged between the deck rails, e.g. as a connecting beam 11 or provided on a connecting beam 11, as to align movement of the supporting member 7 in the direction of the deck rail. The deck rail may be provided at its upper end with a stop member to prevent the supporting member from vertically unlocking of the deck rail 6, e.g. an upside-down T-shaped construction. Instead, the supporting member may be movable arranged over the deck rail 6.

Figure 3:
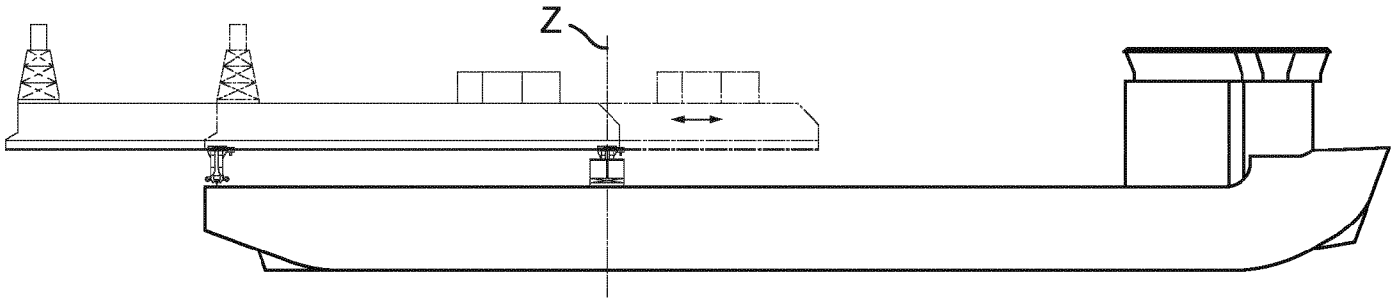
FIG. 3 shows a schematic side view of an embodiment of an offshore structure with a skidding system with a fixed rotation shaft.
Figure 4:
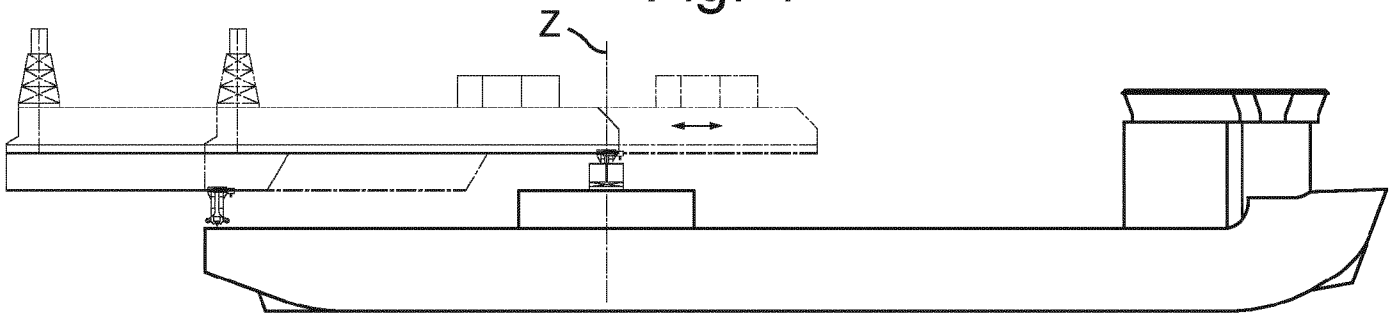
FIG. 4 shows a schematic side view of an embodiment of an offshore structure with a skidding system with a fixed rotation shaft, mounted onto an elevated level.

As shown in FIGS. 1-7, the rotating system 12 may comprise a forward located yoke or connecting beam 11, which is mounted on a centrally located bearing 13 having a vertical rotation axis C, wherein the bearing is fixedly mounted on the deck 5, as in FIG. 3, or on an elevated level of the deck 5, as in FIG. 4, of the jack-up. In its neutral position the yoke 11 is oriented in a transverse direction, and it can be rotated to an angle Ψ from this neutral position, by a rotation of the central bearing 13. The bearing 13 is centrally located with respect to the width of the cantilever, meaning approximately on the centerline of the cantilever 2.

The width of the yoke 11 may be about equal to the width between the outermost edges of the longitudinal rails 8 fitted at the bottom of the cantilever, at least is sufficiently wide such that the longitudinal cantilever rails 8 can be supported onto the yoke 11. The yoke 11 has supports, for example embodied as skid-pads, for example embodied as supporting members 7, at both ends, which support the longitudinal cantilever rails 8. The cantilever rails exert a load on the supports, and the yoke 11 transfers these vertical loads from the supports to the centrally located rotating bearing 13. Skid units or actuating units can be fitted to the yoke at both ends, in line with the supports: these facilitate the longitudinal movement of the cantilever 2, by skidding the longitudinal rails over the supports of the yoke 11. "Longitudinal" means here that the skidding movement is along the centerline L of the cantilever 2, which is typically perpendicular to the yoke, regardless of the direction of the yoke which can be at an angle from its neutral position, in case the yoke 11 is rotated on the central bearing 13.

By providing the supporting members 7 on a connecting beam 11, such as a yoke, alignment between the supporting members 7 on both sides of the point of rotation C of the cantilever 2 can be provided. This connecting beam 11 can hold the supporting members 7 in an aligned position with respect to each other and can keep them at an approximately fixed distance corresponding with the distance between the centerlines of the cantilever rails 8.

In the embodiments of FIGS. 1-7, there are at least two supporting members 7 placed on a transverse deck rail 6 which is fixedly mounted on the aft end of the jack-up's or vessels hull. These supporting members 7 in turn support the longitudinal rails 8 of the cantilever 2.

When the supporting members 7 on the aft deck rail 6 shift in transverse direction, the cantilever 2 will turn around its point of rotation C.

In case of a straight aft rail 6, see e.g. FIGS. 5 and 6, so-called psi-skidboxes can be used as supporting member 7 between the aft deck rail 6 and the cantilever rails 8. In case of a curved rail 6, as in FIGS. 1-2, with a large enough radius, standard GustoMSC® skidboxes can be used as supporting member. When the radius of the curved aft deck rail is smaller than the curvature that can be handled by the conventional XY-skid box, the bottom part of the XY-skidbox can be arranged to hold a curved rail by providing guide members with a corresponding radius. Modified skidboxes can be provided with curved and/or V-shaped guides. Such curved and/or V-shaped guides can allow sufficient play between the guide and the respective rail for the modified skidbox to take a curved rail and/or a deviated rail.

Figure 7:
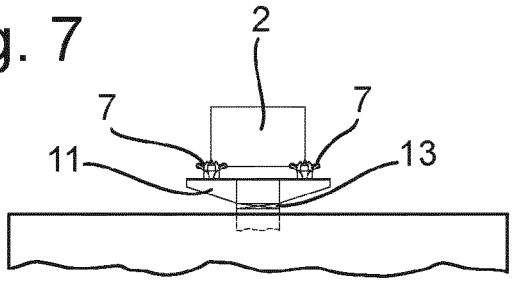
FIG. 7 shows a schematic cross-sectional view of the embodiment of FIG. 3 along the line A-A.

In an embodiment, as shown in FIG. 1 or FIG. 2, a cantilever 2 is pivotally mounted on a deck 5 of an offshore structure 9. The cantilever 2 can rotate about a fixed vertical rotation axis C. In this example the cantilever is connected to the deck via a centrally located bearing 13 providing for a fixed physical rotation shaft. The centrally located bearing 13 is centrally located with respect to the width of the cantilever, meaning approximately on the centerline of the cantilever, as e.g. shown in FIG. 7. FIG. 7 shows a yoke 11 connected to the centrally located bearing 13. The yoke 11 is provided with supporting members 7 bearing the cantilever rails 8 of the cantilever 2.

The centrally located bearing 13 can also be situated at another deck level than the aft skid boxes or even on top of any construction or housing on deck, as for example shown in FIG. 4. Advantageously, to allow for a freely usable main deck below the cantilever, the skidding system is arranged such that the underside of the cantilever is situated at a level about 3 to 4 meters above the main deck, see e.g. FIG. 3 or FIG. 4.

In an embodiment, the rotation point or yoke can also be movable in a transverse or longitudinal direction to extend the reach of the cantilever. This can be achieved by providing additional means such as one or more transverse and/or longitudinal rails on deck and skidboxes between the yoke support and the deck rail.

In the embodiment, as shown in FIG. 1 or FIG. 2, the transverse aft skid rail has a curvature with a radius R1 equal to the distance from the rotation axis C formed by the centrally located rotation bearing 13. The sufficiently large distance between the aft rail and rotating point results in reduced (pulling) loads on the rotating point and respective skidboxes. When the rail has a sufficiently large radius, the curvature can be handled by conventional skid boxes.

When the radius of the curved aft skid rail is smaller than the curvature that can be handled by the conventional XY skidbox, the bottom part of the XY-skidbox can be arranged to hold a curved rail by providing guide members with a corresponding curvature.

The curved rail is especially advantageous for use on a ship shaped jack up, as shown in FIGS. 1 and 2. On a jack-up rig a straight rail located on the aft transom can be more preferable, see FIGS. 5 and 6. In this case the top parts of the skid boxes 7 cooperating with the cantilever rails 8 are arranged to allow the cantilever rail to have a negative or positive angle deviating from the centerline of the top part of the supporting member 7. Alternatively and/or additionally, instead of the top parts, the bottom parts of the skidboxes can be arranged to allow the transverse deck rails 6 to enter at an angle deviating from the centerline of the lower part of the supporting member. Also, both the top and bottom parts of the skidboxes 7 can be arranged to allow the respective cantilever rail 8 to adjust to an angle deviating from the respective centerlines. Also, both the top and bottom parts of the skidboxes can be arranged to allow the respective cantilever rail to adjust to an angle deviating from the respective transverse rail.

Figure 8:
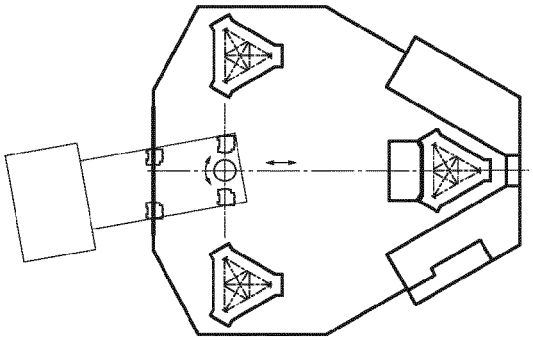
FIG. 8 shows a schematic top view of an embodiment of an offshore structure with a skidding system with a virtual rotation axis with the cantilever in extended position.
Figure 9:
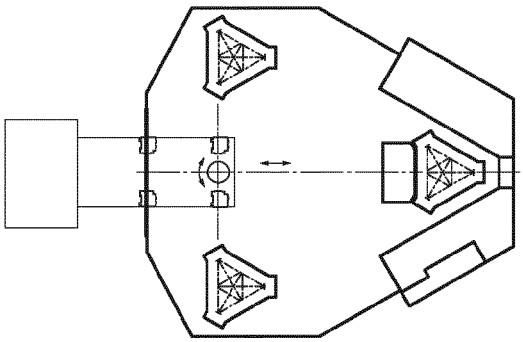
FIG. 9 shows a schematic top view of the offshore structure of FIG. 8 with the cantilever in longitudinal extended position.

In another embodiment, see FIGS. 8-9, the forward yoke may be omitted and two placed apart skidboxes 7 may be provided instead. These placed apart skidboxes are at a top side arranged to couple with the cantilever rails 8 and can be at a bottom part arranged to couple with a deck-rail or -rails. These deck-rail(s) may have a linear/straight configuration and may be oriented transverse with respect to the cantilever rails, or may be curved with an orientation substantially transverse to the cantilever rails as well. The curved rails preferably have a radius R1 with a center at a fixed rotation point C on the deck 5. Then, rotation of the cantilever around this rotation point may be facilitated. To accommodate reaction forces and other loads, a connecting beam may be provided between the two placed apart forward skid boxes, if necessary.

When using two placed apart skidboxes at the forward end of the cantilever coupling with transverse deck rail or rails at the lower end and longitudinal cantilever rails at the upper end, the cantilever can rotate and translate without a fixed rotation point, i.e. a floating rotation point, as in FIGS. 8 and 9.

By providing a rotation system with two placed apart supporting members, there is no fixed pivoting axis required, so contrary to the prior art, there is no single point on deck that needs to take up all the load. Instead, now there may be an even load distribution over the support elements, which improves the load transfer to the hull construction.

Further, in some embodiments it may be advantageous to provide the underside of the cantilever relatively close to the deck, as to improve the stability of the vessel or jack-up during transit. By providing such a rotating system, a relatively low free height between deck and underside cantilever may be possible. Thereto, a supporting member with a relatively low height, see e.g. in FIG. 14, can be provided.

When providing three or four supporting members as shown in e.g. FIG. 8 and FIG. 9, the cantilever may be rotated in the absence of a centrally located rotation point or rotation bearing, but with a floating rotation point instead. By providing here supporting members 7 according to the invention, with a top part having a guide element engaging the cantilever rail and a bottom part having a guide element engaging the deck rail, wherein the top part and/or the bottom part are configured to allow off-centerline movement of the rail engaged therein, rotational movement of the cantilever with respect to the deck can be facilitated. In an embodiment, the top part guide element and the bottom part guide element having an oblique angle with respect to each other, movement of the cantilever over these deck rails becomes possible with much simpler and lighter supporting members as opposed to the prior art supporting members. Contrary to the prior art supporting members that comprise a hinge between the top part and the bottom part such that, upon movement of the cantilever, the top part pivots with respect to the bottom part, providing for a complex and heavy supporting member. According to the invention, rotation of the cantilever can e.g. be achieved by moving the supporting members 7 on the aft deck rail over a different distance than the supporting members 7 on the forward deck rail. The top and/or bottom part of the supporting members are configures to allow off-centerline movement of the respective rail to the top and/or bottom part respectively. By allowing such off-centerline movement, rotation of the cantilever with respect to the deck can be obtained. The angles between the transverse rails on deck and the longitudinal rails of the cantilever are taken up by the supporting members 7, preferably the angle is equally divided over the respective supporting members 7. Active and/or passive controls can be used to control the supporting members 7.

Since the cantilever has, in this embodiment of FIGS. 8-9, no fixed pivoting point, there is no predetermined rotation axis. Depending on the position of the cantilever, the position of the rotation axis can be different. The rotation axis can then be said to be floating.

Figure 10:
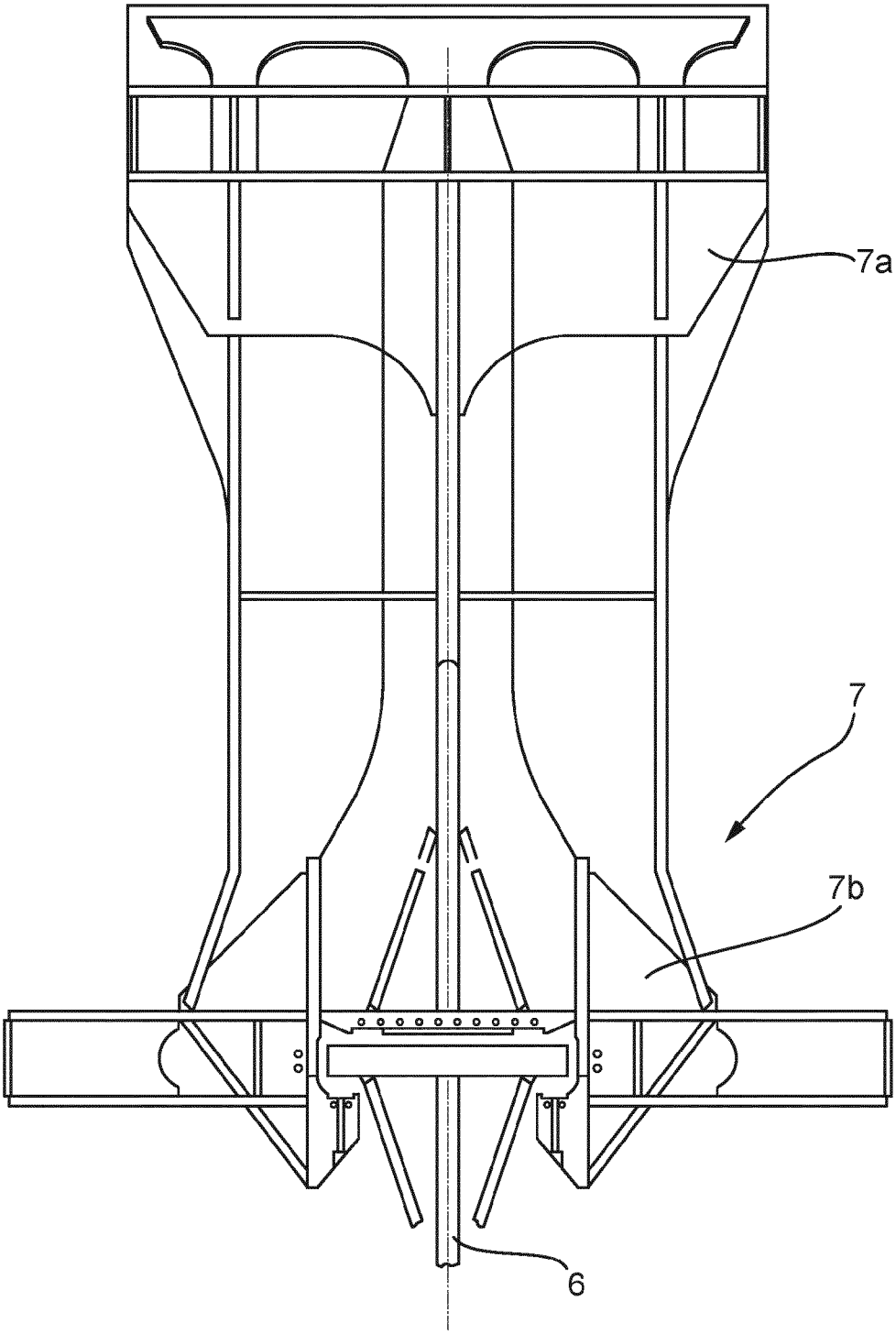
FIG. 10 shows a schematic side view of a supporting member.

FIGS. 10 and 11 show a supporting member 7 allowing the cantilever rail 8 or a deck rail 6 to have a centerline deviating from the centerline of the top part 7*a* and the bottom part 7*b*. Typically, such a supporting member 7 has no pivoting mechanism and can rotate around a Z-axis transverse to the plane of the cantilever and/or deck rails. The Z-axis can typically be a vertical axis. By providing such a supporting member 7, rotating movement of the cantilever 2 can be accommodated on a straight aft transverse deck rail 6 and with straight longitudinal cantilever rails 8, or on a curved aft transverse deck rail 6 with straight longitudinal cantilever rails 8.

The supporting members 7 can be arranged to allow a cantilever rail 8 to enter at a deviating angle by providing a curved guiding element 15 alongside at least one side, preferably alongside both sides, of the rail, each guiding member comprising an arc shape or e.g. a V-shape which is close to the rail at its middle and flaring further outwardly from the rail at its ends of the supporting member 7. The cylinders of the skid unit, connected thereto are suitably arranged to be able to push or pull the rail through the upper or bottom part of the supporting member 7 in a direction deviating from the centerline of the supporting member 7. The curved guide elements 15 can be provided on the top part of the supporting member 7 to guide the cantilever rail 8, and/or can be provided on the bottom part 7*b* of the supporting member to guide the deck rail 6. See FIG. 10 and FIGS. 11*a*, 11*b*, 11*c*, and 11*d*.

Active or passive control may be provided to make sure the deviating angle between the two deck rail and cantilever rail is taken up by both the top part and the bottom part of the supporting member, preferably in an evenly distributed manner.

By providing curved and/or V-shaped guides, sufficient play in the system can be allowed to have the supporting member rotating up to an angle β of approximately 5 to 10 degrees, to one side, for example 7.5 degrees, with respect to a straight deck rail or straight cantilever rail. By providing such a guide element 15 both at the top part and at the bottom part of the supporting member 7, play is allowed to accommodate rotation with respect to the deck rail as well as with respect to the cantilever rail, allowing a maximum rotation of the cantilever with respect to the deck of for example 15 degrees, i.e. twice the 7.5 degree for each guiding element. In an embodiment, the upper and lower curved guiding member 15 may be coupled, e.g. hydraulically, to provide for rotation on the upper and lower guide member in the same direction.

In another embodiment, FIG. 12*a* shows the longitudinal rails 8 on the bottom side of a cantilever 2 with two supporting members 7 placed apart at the forward end of the cantilever 2. FIG. 13*a* shows a detail of FIG. 12*a* with forward supporting members 7 with skid-units 16, i.e. actuating units, for actively moving the cantilever 2 in its longitudinal direction.

FIG. 12*b* shows also the longitudinal rails 8 on the bottom side of a cantilever 2 with two supporting members 7 placed apart at the forward end of the cantilever 2, but with a connecting beam 11 between the two placed apart skidboxes/supporting members 7. FIG. 13*b* shows a detail of the skidboxes 7 with the connecting beam 11 and FIG. 15 shows a cross-section view thereof along the line A-A in FIG. 16. In the example of FIGS. 13*a* and 13*b* the cantilever 2 has a virtual rotation axis C which position is fixed with respect to the deck 5 of the vessel 4. The connecting beam 11 allows the skidboxes 7 to be placed apart and to take up loads. The connecting beam 11 can also be connected to the deck. The connecting beam can be connected to the deck at a fixed pivoting point. In this example the connecting beam is connected to the deck via a curved forward rail 17 having its center point C at the rotation point C of the cantilever 2. So, here the cantilever 2 has a rotation axis C fixed with respect to the vessel or jackup, as the cantilever 2 itself may also move in its longitudinal direction. However, by providing the placed apart skidboxes, the loads are divided and the pivoting shaft, such as a bearing 13 or the forward curved rail 17, does not have to take up all loads, thus allowing for a better load distribution to the deck and/or the hull of the vessel.

As can be seen in FIGS. 13*a* and 13*b*, the guides between which the bottom part of the skidbox are arranged, are curved with a radius of a circle having its center point at the rotation point of the cantilever. Here, the supporting members have skid unit 16 at the top part, thus also providing actuation of the cantilever with respect to supporting member 7 (and vice versa).

It will be appreciated that the supporting member shown in FIG. 15 may be used on the rotating system of FIG. 12*a*.

FIG. 13*c* shows an example wherein the supporting members 7 are not placed on curved rails, but e.g. on straight longitudinal rails. Since the cantilever has no fixed pivoting point, there is no predetermined rotation axis, and depending on the position of the cantilever, the position of the rotation axis is thus different. The rotation axis can then be said to be floating.

In an embodiment of the rotating system, shown e.g. in FIGS. 13*a* and 13*b*, there are two curved deck rails 6. Here, the radius R2 of the centerline of each curved deck rail 6 corresponds with the distance of the centerline of the deck rail to the point of rotation C of the cantilever. The deck rails 6 are positioned to both sides of the cantilever 2, such that the radial centerlines of the deck rails (at the middle of the deck rail) are in line with each other, crossing the point of rotation of the cantilever, and substantially perpendicular to the centerline of the vessel or jack-up. In this embodiment both deck rails may extend for at least 10 deg to both sides of their radial centerline.

The deck rail 6 may have the form of an upside-down T-shaped track, with side walls fixed on the deck and top plates forming a slot along the centerline of the guide, as e.g. shown in FIG. 14. The deck rail 6 can have a bottom plate or can use the deck surface 5 as the bottom plate. Inside, the deck rail is preferably be provided with sliding elements, preferably sliding bearings. Sliding elements are provided at least at one side wall and the bottom surface. The top plates hold the supporting member 7 in place when pulling loads occur. By providing such a deck rail structure, the height of the supporting member 7 can remain relatively limited. Alternatively, the deck rail 6 can be embodied as a T-shaped rail over which the bottom part of the supporting member can hold or clamp.

The supporting member 7 can have a compact construction, with a base plate 17 at its bottom part 7*b* which interacts with and is received by a recess provided by a deck rail 6, see FIG. 14. This base plate 17 extends under the top plates of the deck rail 6, such that the top plates can hold the supporting member in place. The base plate 17 can have the same curvature as the deck rail 6. On top of the base plate 17, the top part 7*a* of the supporting member 7 is provided, in this embodiment consisting of side walls 18 with top rims 19. Inside, this top part 7*a* has sliding elements, preferably sliding bearings. 'Sliding elements are provided at least at the side walls 18 and on the top surface of the base plate 17. The rims 19 partly enclose the rail 8 of the cantilever to hold the cantilever 2 in place in case of pulling loads.

The longitudinal movement of the cantilever can be effectuated by the aft supporting members 7. The top part 7*a* of the forward supporting members 7 then allows a cantilever rail to move through.

The supporting member 7 of FIG. 14 is a compact and passive version provided in/between the deck rail 6 at its bottom part 7*b* and holds the cantilever rails 8 on the top part 7*a*. As such, the supporting member 7 has a relatively low height, allowing for limited free height between deck 5 and cantilever 2. Here, the supporting member 7 itself is not actuated, and thus is following the movement induced by the actuated aft supporting members. The supporting member shown in FIG. 14 may e.g. be used in the rotating system of FIG. 13*a*, 13*b* or 13*c*.

FIG. 16 and FIG. 17 show a general arrangement of a cantilever 2 with a rotating system on a vessel 4 having an aft deck rail 6 placed transverse at the aft end of the vessel 4 on which at least two supporting members 7 or skidboxes are placed. Here, a cantilever 2 is shown with a fixed rotation axis C at the position of the physical pivoting point. Advantageously, the pivoting point C is located on the centerline X of the vessel and on the centerline L of the cantilever. At the forward end, two curved deck rails 6 are provided in which the bottom part 7*b* of the supporting members 7 can be received. The top parts 7*a* of the supporting members 7 are clamped around and hold the rails 8 underneath the cantilever to allow movement of the cantilever 2 in longitudinal direction of the cantilever. The cantilever 2 can rotate around the fixed pivoting point that is fixed with respect to the deck 5.

In another embodiment, it is also possible to use one supporting member 7 on the aft deck rail 6, providing sufficient load bearing capacity for the cantilever 2, or to use two or more skidboxes connected to each other to form a single part.

In another embodiment, an additional reaction arm may be provided to counteract reaction forces (axial to the cantilever), e.g. by means of said pivoting point or an arm on said beam, the arm being arranged to transfer reaction forces to an additional (curved) guiding element fixed on deck. Instead of the fixed rotation axle, an alternative reaction arm can be provided to counteract the reaction forces. The reaction arm is fixed to the connecting beam and cooperates with an additional reaction arm fixed on deck. This way the reaction forces can be distributed over a larger area. The additional reaction arm can be curved, such that when the reaction arm follows this reaction arm, the connecting beam rotates around the desired point of rotation C of the cantilever 2. This way the fixed rotation axle is not needed.

The connecting beam 11 may further be provided with additional arm(s), possibly integrated with the connecting beam construction, extending transversely with respect to the beam. One end of the arm may be connected to said beam 11 or directly to the supporting member 7 and the other end of the arm may be, e.g. slidably, connected to a rail of the cantilever at a distance from the supporting member, thereby arranged to keep the supporting member aligned to said rail of the cantilever while moving and to align the supporting member 7 with the deck rails for smooth operation.

Further improvement of the alignment of the supporting members 7 to the cantilever rails 8 can be achieved by providing a fixed pivoting point at the point of rotation of the cantilever, as in the embodiments of FIGS. 1-7. The radial centerlines of the supporting members 7 coincide with the centerline of the connecting beam 11. The centerline of the connecting beam 11 crosses the centerline L of the cantilever 2 at its point of rotation C. At this position a fixed rotation axle or shaft, e.g. a bearing 13, can be provided between the connecting beam 11 and the deck 5. With a fixed rotation point C and the connecting beam 11, the supporting members 7 may be optimally aligned and positioned with respect to the cantilever rails 8.

There may be no or limited vertical load on the fixed rotation point or axle, as the load of the cantilever 2 may be distributed over the supporting members 7. The fixed rotation axle 13 can counteract reaction forces (axial to the cantilever) caused by the skidding forces. These reaction forces can otherwise result in displacement or misalignment of the supporting members.

As a result of the rotation of the cantilever 2, each supporting member 7 will be forced to follow the respective deck rail 6 and align with the respective cantilever rail 8. A relatively large force is transferred locally through the guiding parts of the supporting member 7. When the additional reaction arms are used, force is transferred through the connecting beam 11 or directly to the supporting member 7. At the position of the slidable connection of an arm to a cantilever rail, less force is needed to create sufficient moment to align the supporting member 7. Also, with such a reaction arm in place, movement of a cantilever rail 8 around the point of rotation C of the cantilever 2 may result in a more direct actuation of the supporting member 7. The rail pushes directly against the slidable connection, which directly acts on the connecting beam 11 or the supporting member 7 itself. Play between the guiding parts of the supporting member and rail does not have to be overcome first.

Instead of the additional reaction arm, the cylinders of the skid unit or actuation unit of the supporting member, on the top part of the supporting member, can be locked and used as a lever to align the supporting member 7.

A supporting member can also be specifically arranged for the purpose of the configuration shown in FIG. 18. The configuration of FIG. 18 shows a rotating system having two curved deck rails 6 that are arranged in symmetric fashion with respect to the X-direction of the platform and that have an oblique angle $\alpha$ with respect to the Y-direction. The aft deck rail 6 is arranged substantially transverse to the X-direction and is curved having a radius of curvature R1 from the center of rotation C to the centerline of the deck rail 6. The pair of curved forward deck rails 6 have a radius of curvature R2, from the center of rotation C. The angle $\alpha$ denotes the angular position of the radial centerline of a forward curved deck rail 6 (from the middle of the deck rail 6 through the point of rotation C of the cantilever) with respect to the Y-axis. In FIG. 18 both forward curved deck rails 6 are positioned forward of the (virtual) rotation point C of the cantilever 2. In this example the angle $\alpha$ is approximately +30 degrees. The angular extent of the forward curved guide in this example is approximately 20 degrees (+/−10 degrees relative to the radial centerline).

More in general the angular extent of the forward curved guides can e.g. be between 10 and 45 degrees. The angle alpha can be between approximately 5 degrees and approximately 50 degrees, preferably between approximately 10 and approximately 45 degrees, or preferably around 30 degrees.

To accommodate this configuration, the bottom part 7*b* of the supporting member 7, can have a centerline with a radius corresponding to R1 or R2 of the curved rail segment, and is arranged to travel along the curved deck rail 6. The top part 7*a* of supporting member 7 can be arranged to receive and hold a cantilever rail 8 and to allow the cantilever 2 to move through in the longitudinal direction of the cantilever 2.

In FIG. 18 the cantilever 2 is shown in a position pivoted over an angle Ψ with respect to the X-direction.

In the embodiments of FIGS. 19*a*, 19*b*, 20*a*, 20*b*, forward curved deck rails 6 under an oblique angle α are provided and a curved aft deck rail 6. In the embodiment of FIG. 20*a*, 20*b*, further a connecting beam 11 is provided between the forward curved deck rails 6. The aft supporting members 7 are provided with skid-units 16. The skid units 16 at the top part 7*a* of the supporting member 7 effectuate the longitudinal movement of the cantilever 2. The skid units 16 at the bottom part of the supporting member 7 effectuate the transverse movement of the cantilever 2, at the location of the aft deck rails. This results in an augmented transverse shift at aft end of the cantilever extended over the stern of the vessel 4, while at the same time the transverse movement at the location where the jackhouses with legs 10 are located, is reduced. This reduction is dependent on the relative lengthwise location of the jackhouses 20 of the legs 10 between the aft deck rails and the forward located rotation bearing 13.

Typically, the skid unit 16 comprises the parts for moving the rail. Thereto the skid unit 16 can include a yoke and (hydraulic) cylinders. The skid unit can be configured with hydraulic cylinders in combination with pin/hole connections with the holes in the rail or gripper systems clamping on the rail. Alternatively, or additionally, the skid unit 16 can have an associated rack and pinion system. The pinion can be part of the skid unit 16. The rack can be part of, or associated with, the respective rail. This rack and pinion system can be electric or hydraulic or air driven or any other power source.

The top part 7*a* of the supporting member 7 can be configured with a skid unit 16 for actively effectuating longitudinal movement of the cantilever 2 with respect to the supporting member 7. This may reduce the required force which has to be delivered by the aft supporting member 7 and may improve smooth operation.

Rotation of the cantilever 2 can be effectuated by moving the aft supporting members 7 in a transverse direction, i.e. in Y-direction. The aft supporting members 7 will then have to allow or actuate the rail 8 of the cantilever to move with respect to the supporting member 7. The transverse movement will turn the cantilever around the point of rotation. Each rail will push the respective forward supporting members to follow the respective guide.

The top part 7*a* of an aft supporting member 7 can be configured with a skid unit 16 for actively effectuating movement of the cantilever. The top part can also be configured without skid unit. The movement of the cantilever may then have to be induced by other actuating means, such as the forward supporting members.

The bottom part 7*b* of an aft supporting member can be configured with a skid unit for actively effectuating transverse movement of the supporting member 7 along the aft deck rail, resulting in the rotational (Psi-direction) movement of the cantilever 2.

Optionally, the aft supporting members are provided with skid units. Optionally, the forward supporting members are provided without skid units.

The bottom part 7*b* of the supporting member 7 can be provided with a skid unit 16 to actively move the supporting member 7 with respect to the deck rail 6. This may reduce the required force which has to be delivered by the aft supporting member and may improve smooth operation.

The skid unit 16 at the top part of an aft supporting member effectuates the longitudinal movement of the cantilever, along the X-direction.

The deck rails 6 can be equipped with guiding elements on the side walls to take up the reaction forces and associated friction which occurs when the cantilever pushes the supporting members along the deck rails, either in a forward or aft direction. These forces can vary par rail or per side, possibly resulting in misalignment of the supporting members.

The transverse deck rail can be curved, e.g. having a radius of curvature corresponding to the distance between the transverse skid rail and the rotation axis of the cantilever. Conventional supporting members can be used on such curved rail if the radius of curvature is large enough. If the radius of curvature is smaller, modified supporting members can be used, arranged to receive curved rails with a smaller radius.

The transverse skid rail can be straight. It will be appreciated that an angle between the transverse deck rail and the cantilever rails can vary depending on a rotation of the cantilever relative to the deck. Modified supporting members, according to the invention, can be used to take rails under such deviating angles (herein also referred to as psi-skidbox).

The supporting member can be provided with curved and/or V-shaped guide elements for receiving a rail. Such curved and/or V-shaped guide elements can allow sufficient play between the deck rail and the respective rail for the supporting member to take a curved rail and/or a deviated rail.

Alternatively, the forward curved guides 6 can be positioned aft of the (virtual) rotation point of the cantilever. This is for example shown in FIG. 19*a* in top plan view. FIG. 19*b* shows a side view of the construction in FIG. 19*a*. In this example the angle −α is approximately −30 degrees. The angular extent of the forward curved guide in this example is approximately 20 degrees (+/−10 degrees relative to the radial centerline). More in general the angular extent of the forward curved guides can e.g. be between 10 and 45 degrees. The angle −alpha can be between approximately −5 degrees and approximately −50 degrees, preferably between approximately −10 and approximately −45 degrees, or preferably around −30 degrees.

FIG. 20*a* shows an example of a top plan view similar to that shown in FIG. 19*a*. FIG. 20*b* shows a side view of the construction in FIG. 20*b*. In this example the forward supporting members are connected through a connecting beam 11. It is noted that such connecting beam is also shown in FIG. 13*b*. In order to further improve the alignment or the supporting members, a rotation axle or shaft fixed to the deck can be provided. This fixed rotation axle and possibly an additional reaction arm can further assist in counteracting the reaction forces. The connecting beam 11 may further be provided with additional arm(s), to transfer the pushing force of the cantilever rail, which occurs when supporting members on the aft deck rail 6 move in transverse direction, directly to the supporting member 7.

FIG. 21 shows an example of a skid unit 16 using a rack and pinion system. In this example both the transversal deck rail 6 and the cantilever deck rail 8 have a rack 21 associated therewith. The supporting member 7 has two skid units 16 attached thereto. The skid units 16 comprise pinions 22 cooperating with the respective racks 21. It will be appreciated that the rack and pinion systems can also be viewed in FIGS. 19*a*, 19*b*, 20*a* and 20*b*. In those examples each skid units 16 includes four pinions 22.

FIG. 22*a* shows a first view of an example of a forward curved deck rail 6. The forward curved deck rail 6 is formed as a generally T-shaped rail. On top of the forward curved deck rail 6 is a forward supporting member 7. The forward supporting member 7 is provided with a bottom part 7*b* which is arranged to cooperate with the curved deck rail 6. The forward supporting member 7 comprises a bottom guide element 23 grips around a top portion of the forward curved deck rail 6 so as to prevent lifting the supporting member 7 off the deck rail 6. On top of the forward supporting member is a cantilever rail 8. The top part 7*a* of the forward supporting member 7 has a guide element 24 is arranged to receive and hold a cantilever rail 8 and allow the cantilever 2 to move through in the longitudinal direction of the cantilever 2. The forward supporting member 7 grips around a bottom portion of the cantilever rail 8 so as to prevent lifting the cantilever rail off the supporting member 8. FIG. 22*b* shows a second view of the example shown in FIG. 22*a*. The bottom guide element 23 and the top guide element 24 have an oblique angle with respect to each other allowing for longitudinal and angular movement of the cantilever with respect to the deck.

The bottom part 7*b*, including the guiding element 23, can have a centerline with a radius corresponding to R2 of the curved rail segment 6, and arranged to travel along the curved deck rail. This bottom part 7*b* can have one or more curved guiding elements, with a curvature corresponding with R2, extending alongside at least one, in this example alongside both sides, of the rail 6. The top part 7*a* can be configured with a skid unit 16 for actively effectuating movement of the cantilever (not shown).

FIG. 23*a* shows a first view of an example of an aft curved deck rail 6. The aft curved deck rail 6 is formed as a generally T-shaped rail. On top of the aft curved deck rail is an aft supporting member 7. The aft supporting member 7 is provided with a bottom part 7*b* having a guide element 23 which is arranged to cooperate with the curved deck rail 6. On top of the aft supporting member is a cantilever rail 8. The top part 7*a* of the aft supporting member 7 is arranged to receive and hold a cantilever rail 8 and allow the cantilever 2 to move through in the longitudinal direction of the cantilever. FIG. 23*b* shows a second view of the example shown in FIG. 23*a*.

The bottom part 7*b*, including the guiding elements 23, can have a centerline with a radius corresponding to R1 of the curved guide or curved rail segment, and arranged to travel along the curved deck rail. This bottom part 7*b* can have one or more curved guiding members, with a curvature corresponding with R1, extending alongside at least one, in this example alongside both sides, of the rail or guide. When the radius R1 is sufficiently large, the bottom part can also have straight guiding elements 23. The upper and bottom part 7*a*, 7*b* can be configured with a skid unit for actively effectuating movement of the cantilever (not shown).

It will be appreciated that in FIGS. 23*a* and 23*b* the supporting members 7 have eyes 25 to which the skid units can be attached (also see FIG. 21).

It is also possible that the forward rotating system includes or consists of two skid shoes 26, see FIGS. 25*a*-25*d*. The two skid shoes 26 can be placed apart and fixed to the deck 5 at a distance corresponding with the distance between the cantilever rails 8. The skid shoes 26 therefore are immobile relative to the deck 5.

The skid shoes 26 can be at an equal distance from the longitudinal centerline of the vessel or jackup 4. The centerline of the skid shoe 26 can be parallel to the centerline of the vessel or jack-up. Each skid shoe 26 is arranged to support a cantilever rail 8 and allow it to move through in a longitudinal direction. The skid shoes 26 can be combined with any aft supporting system described herein.

FIGS. 24*a* and 24*b* show a top plan view and front view of an example of a skid shoe 26, respectively. The skid shoe 26 forms a guide element 24 as an upside down T-shaped track, with side walls 27 fixed to a bottom plate 28 or directly to the deck and top plates 29 forming a slot along the centerline of the shoe 26. This shoe is provided with sliding elements 30, such as sliding bearings, at least at one side wall 27 and the bottom surface 28.

The forward skid shoes 26 are in a fixed position, which means the cantilever rails will move through the skid shoes but cannot move sideways at the position of the skid shoe, resulting in the cantilever 2 having an angle deviating from the centerline of the skid shoe 26. Therefore, the skid shoe 26 is arranged to prevent locking of the rail 8 in the skid shoe 26 due to skewing if the cantilever rail 8 deviates relative to the skid shoe center line. The skid shoe 26 can therefore be arranged to allow the cantilever rail 8 to have an angle $\gamma$ deviating from the centerline of the skid shoe by providing sufficient play between rail 8 and guiding elements 15 and by providing a curved guiding element 15 alongside at least one side, preferably along both sides, as can be seen in FIG. 24*a*.

FIGS. 25*a*, 25*b*, 25*c* and 25*d* show an example of a skid shoe including includes hinged guiding elements 15 for guiding the cantilever rail. In this example the skid shoe includes two opposed hinged guiding elements 15. It will be appreciated that it is also possible that the skid shoe includes a single hinged guiding element. The hinged guiding elements are arranged for rotation about a vertical axis. The hinged guiding elements can rotate in a plane parallel to the deck around a vertical rotation axis E.

The hinged guiding element 15 provide a larger supporting surface along the longitudinal direction of the cantilever rail 8. When the cantilever rail makes an angle $\gamma$ relative to the skid shoe center line, the hinged guiding elements will rotate to accommodate rotation of the cantilever rail. Thereby, sideways forces are transferred to the skid shoe (also) via the hinged guiding elements 15. As can be seen in FIG. 25*d*, the part of the skid shoe overhanging part of the cantilever rail so as to prevent uplifting of the cantilever rail is shorter than the hinged guiding elements in longitudinal direction of the cantilever rail. The angle $\gamma$ can be between approximately 0 and approximately 20 degrees, preferably around 5 degrees.

In another embodiment the rotation point E is close to the edge of the platform and/or the skidboxes are on an inwardly placed skidding beam.

Instead of using skid boxes as supporting members for the cantilever also bogie wheels can be used. Bogie wheels, for example of the type with curved contact surfaces as described in WO98/31585, are especially suitable for curved rails. During transit the bogie wheels can be sea fastened.

Herein, the invention is described with reference to specific examples of embodiments of the invention. It will, however, be evident that various modifications and changes may be made therein, without departing from the essence of the invention. For the purpose of clarity and a concise description features are described herein as part of the same or separate embodiments, however, alternative embodiments having combinations of all or some of the features described in these separate embodiments are also envisaged.

For instance, it will be appreciated that any forward rotating system disclosed herein can be combined with any aft supporting system disclosed herein.

For the purpose of clarity and a concise description features are described herein as part of the same or separate embodiments, however, it will be appreciated that the scope of the invention may include embodiments having combinations of all or some of the features described.

The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain features are recited does not indicate that a combination of these features cannot be used to an advantage.

Many variants will be apparent to the person skilled in the art. All variants are understood to be comprised within the scope of the invention.

The invention claimed is:

1. An offshore structure comprising:

a platform having a deck with an X-direction corresponding to a centerline of the platform;

a cantilever mountable on the deck and movable with respect to the deck of the platform;

a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis; such that the cantilever is movable between a retracted position in which it substantially is above the deck, and an extended position in which it is substantially extended outside of the deck;

wherein the skidding system comprises:

a pair of longitudinal cantilever rails mounted to a bottom side of the cantilever, and a rotating system arranged to support and allow rotation of the cantilever with respect to the deck around the vertical axis;

a supporting system arranged to support the cantilever on the deck mounted at a distance from the rotating system along the X-direction;

supporting members arranged to engage the longitudinal cantilever rails with the rotating system or the supporting system;

wherein the supporting system comprises at least one deck rail arranged in a Y-direction substantially transverse to the X-direction; and wherein the rotating system comprises at least two deck rails mounted in symmetrical fashion with respect to the X-direction and having an angle with respect to the Y-direction, and the at least one deck rail of the supporting system and/or the at least two deck rails of the rotating system are curved wherein the at least two deck rails of the rotating system are curved with respect to the vertical rotation axis and have a radius, wherein the at least one deck rail of the supporting system is either (a) curved with respect to the vertical rotation axis and has a radius, or (b) straight and has a distance with respect to the vertical rotation axis; and wherein the radius or distance of the at least one deck rail of the supporting system is larger than the radius of the at least two deck rails of the rotating system.

2. The offshore structure according to claim 1, wherein the angle is an oblique angle and is between approximately 0 degrees and approximately 90 degrees.

3. The offshore structure according to claim 1, wherein the at least one deck rail of the supporting system is mounted aft of the deck.

4. The offshore structure according to claim 1, wherein the supporting members comprise a top part and a bottom part wherein the top part and/or the bottom part are configured to allow rotational movement of the rail to which it is engaged, during rotation of the cantilever with respect to the deck.

5. The offshore structure according to claim 4, wherein the top part and/or bottom part comprises a guide element for receiving the rail, wherein the guide element has a width larger than a width of the cantilever rail, to allow for rotational movement of the rail.

6. The offshore structure according to claim 4, wherein the top part and/or bottom part comprises a guide element for receiving the rail, and wherein the guide element has curved or V-shaped guide walls to allow for rotational movement of the rail.

7. The offshore structure according to claim 1, wherein each supporting member is actuated by a skid unit comprising a rack and pinion system.

8. An offshore structure comprising:

a platform having a deck with an X-direction corresponding to a centerline of the platform;

a cantilever mountable on the deck and movable with respect to the deck of the platform;

a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis; such that the cantilever is movable between a retracted position in which it substantially is above the deck, and an extended position in which it is substantially extended outside of the deck;

wherein the skidding system comprises:

a pair of longitudinal cantilever rails mounted to a bottom side of the cantilever, and a rotating system arranged to support and allow rotation of the cantilever with respect to the deck around the vertical axis;

a supporting system arranged to support the cantilever on the deck mounted at a distance from the rotating system along the X-direction;

supporting members arranged to engage the longitudinal cantilever rails with the rotating system or the supporting system;

wherein the supporting system comprises at least one deck rail arranged in a Y-direction substantially transverse to the X-direction; and wherein the rotating system comprises at least two deck rails mounted in symmetrical fashion with respect to the X-direction and having an angle with respect to the Y-direction, and the at least one deck rail of the supporting system and/or the at least two deck rails of the rotating system are curved, wherein each of the supporting members arranged to engage with the supporting system and/or the rotating system comprises a bottom part for engagement with one of the deck rail(s) and a top part for engagement with one of the cantilever rails, wherein the top part and/or the bottom part are configured to allow off-centerline movement of one of the rails with respect to the centerline of the top part and/or the bottom part respectively and wherein the top part and/or the bottom part of each of the supporting members have an oblique angle with respect to each other.

9. An offshore structure comprising:

a platform having a deck with an X-direction corresponding to a centerline of the platform;

a cantilever mountable on the deck and movable with respect to the deck of the platform;

a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis; such that the cantilever is movable between a retracted position in which it substantially is above the deck, and an extended position in which it is substantially extended outside of the deck;

wherein the skidding system comprises:

a pair of longitudinal cantilever rails mounted to a bottom side of the cantilever, and a rotating system arranged to support and allow rotation of the cantilever with respect to the deck around the vertical axis;

a supporting system arranged to support the cantilever on the deck mounted at a distance from the rotating system along the X-direction;

supporting members arranged to engage the longitudinal cantilever rails with the rotating system or the supporting system:

wherein the supporting system comprises at least one deck rail arranged in a Y-direction substantially transverse to the X-direction; and wherein the rotating system comprises at least two deck rails mounted in symmetrical fashion with respect to the X-direction and having an angle with respect to the Y-direction, and the at least one deck rail of the supporting system and/or the at least two deck rails of the rotating system are curved, wherein each of the supporting members arranged to engage with the supporting system and/or the rotating system comprises a bottom part for engagement with one of the deck rail(s) and a top part for engagement with one of the cantilever rails, wherein the top part and/or the bottom part are configured to allow off-centerline movement of one of the rails with respect to the centerline of the top part and/or the bottom part respectively and wherein the bottom part has a curvature corresponding to a curvature of a deck rail on which it is engaged.

10. An offshore system comprising:

a platform having a deck;

a cantilever mountable on the deck and movable with respect to the deck of the platform;

a skidding system that is arranged for supporting and moving the cantilever with respect to the deck, wherein the skidding system is arranged for translational movement of the cantilever along a longitudinal direction of the cantilever and for rotational movement of the cantilever around a vertical rotation axis, such that the cantilever is movable between a retracted position in which it substantially is above the deck, and an extended position in which it is substantially extended outside of the deck;

wherein the skidding system comprises a pair of longitudinal cantilever rails mounted to a bottom side of the cantilever, and at least a pair of skid shoes mountable on the deck, wherein a top part of a skid shoe is arranged to receive and guide a cantilever rail;

wherein the top part of the skid shoe is configured to allow the cantilever rail to have an angle deviating from a centerline of the skid shoe during rotation of the cantilever and wherein the top part of the skid shoe comprises adjustable guide walls to receive the cantilever rail therebetween and to allow rotational movement of the cantilever rail.

11. The offshore structure according to claim 10, wherein each skid shoe is fixedly mounted onto the deck of the platform.

12. The offshore structure according to claim 10, wherein the top part of each skid shoe has curved or V-shaped guide walls to receive the cantilever rail therebetween and to allow rotational movement of the cantilever rail.

13. The offshore structure according to claim 10, further comprising a deck rail configured in Y-direction of the deck with at least two supporting members arranged to engage the longitudinal cantilever rails with the deck rail.

14. The offshore structure according to claim 13, further comprising two skid shoes arranged at a distance from the deck rail, in the X-direction, and in symmetrical fashion with respect to each other about the X-direction.

15. A supporting member comprising a bottom part arranged to engage a curved deck rail and a top part arranged to engage a cantilever rail, wherein the top part and/or the bottom part are configured to allow rotational movement of the rail to which it is engaged during rotation of the cantilever rail with respect to the curved deck rail wherein the top part and/or bottom part comprises a guide element for receiving a rail, wherein the guide element has a width larger than a width of the rail, to allow for rotational movement of the rail, and wherein the top part and/or bottom part comprises a guide element for receiving the rail, the guide element has curved or V-shaped guide walls to allow for rotational movement of the rail.

16. The supporting member according to claim 15, wherein the top part and the bottom part are arranged to have an oblique angle with respect to each other.

17. The supporting member according to claim 16, for use in an offshore structure.

* * * * *